US006978962B1

(12) United States Patent
Fore, Sr. et al.

(10) Patent No.: US 6,978,962 B1
(45) Date of Patent: Dec. 27, 2005

(54) WIRE WINDING MACHINE WITH ARCUATE MOVEABLE TRAVERSE AND WIRE DIRECTIONAL CONTROL DEVICE

(75) Inventors: James R. Fore, Sr., Canton, NC (US); James R. Fore, II, Canton, NC (US); Gary Ball, Candler, NC (US); Jeffrey Franklin, Candler, NC (US); Michael Williams, Candler, NC (US)

(73) Assignee: X-Spooler, Inc., Canton, NC (US)

( * ) Notice: Subject to any disclaimer, the term of this patent is extended or adjusted under 35 U.S.C. 154(b) by 276 days.

(21) Appl. No.: 10/087,585

(22) Filed: Mar. 1, 2002

(51) Int. Cl.[7] ..... B65H 54/00; B65H 54/02

(52) U.S. Cl. ..... 242/474.4; 242/177; 242/157 R; 242/157.1; 226/151

(58) Field of Search ..... 242/474.4, 177, 242/157 R, 157.1; 226/151

(56) References Cited

U.S. PATENT DOCUMENTS

| | | | | |
|---|---|---|---|---|
| 1,976,611 | A | 10/1934 | Gulliksen | |
| 2,929,569 | A | 3/1960 | Detrick | |
| 2,971,709 | A | 2/1961 | Ellis, Jr. | |
| 3,877,653 | A | 4/1975 | Foltyn | |
| 3,980,244 | A | 9/1976 | Pietroni | |
| 4,015,785 | A | 4/1977 | Ikegami et al. | |
| 4,098,467 | A * | 7/1978 | Engmann et al. | 242/474.4 |
| 4,892,262 | A | 1/1990 | Hurst | |
| 5,499,775 | A | 3/1996 | Vander Groef | |
| 5,598,418 | A | 1/1997 | Lo et al. | |
| 5,678,778 | A | 10/1997 | Kotzur et al. | |
| 6,009,164 | A | 12/1999 | Yun | |
| 6,024,319 | A | 2/2000 | Kawabata et al. | |
| 6,352,215 | B1 | 3/2002 | Cash et al. | |
| 6,377,571 | B1 | 4/2002 | Tai | |
| 2001/0039190 | A1 | 11/2001 | Bhatnagar | |

* cited by examiner

*Primary Examiner*—Kathy Matecki
*Assistant Examiner*—E. Langdon
(74) *Attorney, Agent, or Firm*—Coats & Bennett, P.L.L.C.

(57) ABSTRACT

A wire winding machine includes two mandrels for winding wire alternately thereon. A traverse positions wire axially along each mandrel, and moves in an arcuate path to position wire adjacent one or the other mandrel. A single transfer arm transfers wire from a wound to an unwound mandrel by extending a wire guide adjacent the wound mandrel, retracting the wire guide to engage the wire, rotating to position the wire adjacent the wound mandrel, and extending to guide the wire into a clamping and cutting mechanism. The mechanism clamps and cuts the wire in response to the mandrel end cap being placed into position. The wire winding machine includes a portable operator console, and a network interface. A wire tension control unit includes a radiated signal source and detector to detect movement of a moveable pulley assembly relative to a fixed pulley assembly to control the supply of wire.

42 Claims, 19 Drawing Sheets

WIRE WINDING MACHINE WITH ARCUATE MOVEABLE TRAVERSE AND WIRE DIRECTIONAL CONTROL DEVICE

BACKGROUND OF THE INVENTION

The present invention relates generally to the field of wire winding machines and specifically to an apparatus and method of continuously winding wire onto two mandrels, using a single transfer arm to transfer the wire from one mandrel to the other.

Insulated wire, cable, and similar filamentary material are typically manufactured in very long continuous lengths, and spooled onto large reels. Subsequently, the wire is transferred from these large reels and spooled into coreless packages of predetermined length, which are boxed for retail sale or distribution. The term "package" is a term of art referring to the coil of wire itself, and in particular, the pattern in which the wire is spooled. For example, one common pattern is a "figure 8" wherein successive windings cross over when forming coils on either end. The cross-over points progress radially around the circumference of the coil, with the exception of a void or space formed at one radial point. When the package of wire is placed in a box, the void may accept a pay-out tube affixed to the box and projecting into the interior of the wire coil. The innermost end of the wound cable is then fed through the payout tube, and wire is deployed from the package during use from the interior of the coil.

In forming a package of wire by winding the wire on a mandrel, the formation, size, and placement of the payout tube access void is determined by the relationship between the wire feed along the mandrel in axial direction and the radial position of the mandrel as it winds the wire. This relationship, for a desired package, is influenced by a variety of factors, including the diameter of the wire, the length of wire in the package, the size and shape of the package, and the like. Additionally, the dependencies upon and among these factors are not constant. For example, as the wire is wound, the diameter of the package—and hence its circumference— increases. The resulting increased wire length per wrap must be accounted for to maintain the pay-out access void in one radial position. Various mechanical and geometric systems have been devised in the art to specify the relationship between the axial position of a wire feed and the radial position of a winding mandrel to achieve various packages. A significant advancement in the state of the art of winding wire packages was reached with U.S. Pat. No. 5,499,775, assigned to the assignee of the present application, and incorporated herein in its entirety. This patent discloses that a set of winding parameters, or profiles, may be stored in the memory of a processor or numeric controller, which in turn directly controls the wire feed axial position and the winding mandrel radial position to obtain a desired package for any of a wide variety of wire sizes, lengths, and package types.

The above-referenced patent discloses only a single wire winding mandrel. Operation of a single-mandrel machine requires an interruption in the winding process at the completion of winding each package, as the package is removed from the machine and a new package winding begins. Various dual-mandrel wire winding machines are known in the art. These machines increase efficiency by allowing a package to be wound onto one mandrel while a previously-wound package on the other mandrel is removed by an operator, thus maintaining a continuous output. These machines, however, are mechanically complex, and comprise a large plurality of interworking moving parts, particularly in effecting the transfer of wire from one mandrel to the other. Thus, there exists a need in the art for a dual-mandrel wire winding machine that automatically transfers wire from one mandrel to the other in an orderly, low-cost, mechanically simple manner, while exhibiting high reliability, simplicity, repeatability of operation, and ease of maintenance.

SUMMARY OF THE INVENTION

The present invention entails a wire winding machine that comprises first and second spaced part mandrels and a traverse for supplying wire alternatively to either mandrel. In one embodiment of the present invention, there is provided a single transfer arm for transferring wire from one mandrel to the other mandrel. The single transfer arm is operative to engage the wire or cable being directed to a first mandrel and position the wire adjacent the second mandrel outwardly of the second mandrel's axis of rotation. In an exemplary embodiment of the present invention, the transfer arm is extendable between retracted and extended positions. In one particular mode of operation, the transfer arm in transferring the wire from the first mandrel to the second mandrel is operative to move the wire underneath the second mandrel and then move the wire upwardly to where the wire is secured to the second mandrel. Further, in one embodiment of the present invention, the transfer arm is pivotally mounted and movable between a plurality of positions relative to the two mandrels, and extendable between retracted and extended positions.

The present invention also comprises a wire or cable tension device adapted to accumulate wire or cable and to feed the wire or cable to the wire winding machine. The wire tension control device includes at least two spaced apart pulleys disposed on a frame structure and adapted to accumulate multistrands of wire or cable between the two pulleys, and wherein at least one of the pulleys is movable on the frame structure. A radiated signal measuring device is provided for measuring the distance that the movable pulley moves with respect to a reference point and wherein the measuring device is operative to radiate a signal and detect the radiated signal so as to effectively measure the movement of the movable pulley.

In another embodiment, the wire winding machine of the present invention includes a device for clamping the wire or cable to a mandrel before the mandrel winds the wire or cable thereon. The clamping device of the present invention is actuated and deactuated in response to a removable end cap being placed on or removed from the mandrel. In particular, the clamp acts to secure a wire or cable to the mandrel in response to the end cap being secured to the mandrel and further acts to release the wire or cable in response to the end cap being removed from the mandrel.

In one embodiment of the present invention, the clamping device is associated with a cutting device. That is, the actuation of the clamping device also results in the cable or wire being cut. Thus, in one embodiment, there is provided a clamping and cutting mechanism for a wire winding machine that includes a fixed block including a clamping surface and a cutting edge, a lever including a clamping finger, a cutting finger and an actuating arm, and wherein both the clamping finger and the cutting finger is actuated by engaging and moving the actuating arm.

In another embodiment, the present invention includes a wire-winding machine having a controller for coordinating the axial position of a traverse with a radial position on a mandrel so as to wind wire onto said mandrel in a predetermined package or a predetermined configuration. The wire winding machine of this embodiment includes a portable operator console associated with the controller in a data transfer relationship. The console is operative to receive input from an operator and to relay at least one command related to a wire winding procedure to the controller.

Further, in another embodiment, the present invention entails a wire winding machine having at least one mandrel for winding wire thereon and a traverse for directing wire axially along the mandrel. A controller is provided for coordinating the axial position of the traverse with the radial position of the mandrel so as to wind wire onto the mandrel in a predetermined package or configuration. This embodiment of the wire winding machine is provided with a remote interface for data communications between the controller and at least one remote data terminal. This permits the controller of the wire winding machine to be remotely programmed.

A further embodiment of the present invention entails a wire winding machine having a pair of rotatably driven spaced apart mandrels and a traverse for guiding wire onto each of the mandrels, one mandrel at a time. The traverse is movable between first and second positions such that in the first position the traverse acts to guide wire onto one of the mandrels and in the second position the traverse acts to guide wire onto the other mandrel. Further, the traverse is movable along an arcuate path as the traverse moves between the first and second position.

In another embodiment of the present invention, the wire winding machine is provided with at least one mandrel for winding wire and a traverse for directing wire to the mandrel. In addition, there is provided a wire directional control device for receiving a wire being directed to the mandrel and engaging the wire in such a manner that the wire can move through the device in one direction but is prohibited from moving through the device in an opposite direction.

DETAILED DESCRIPTION OF THE INVENTION

Figure 1:
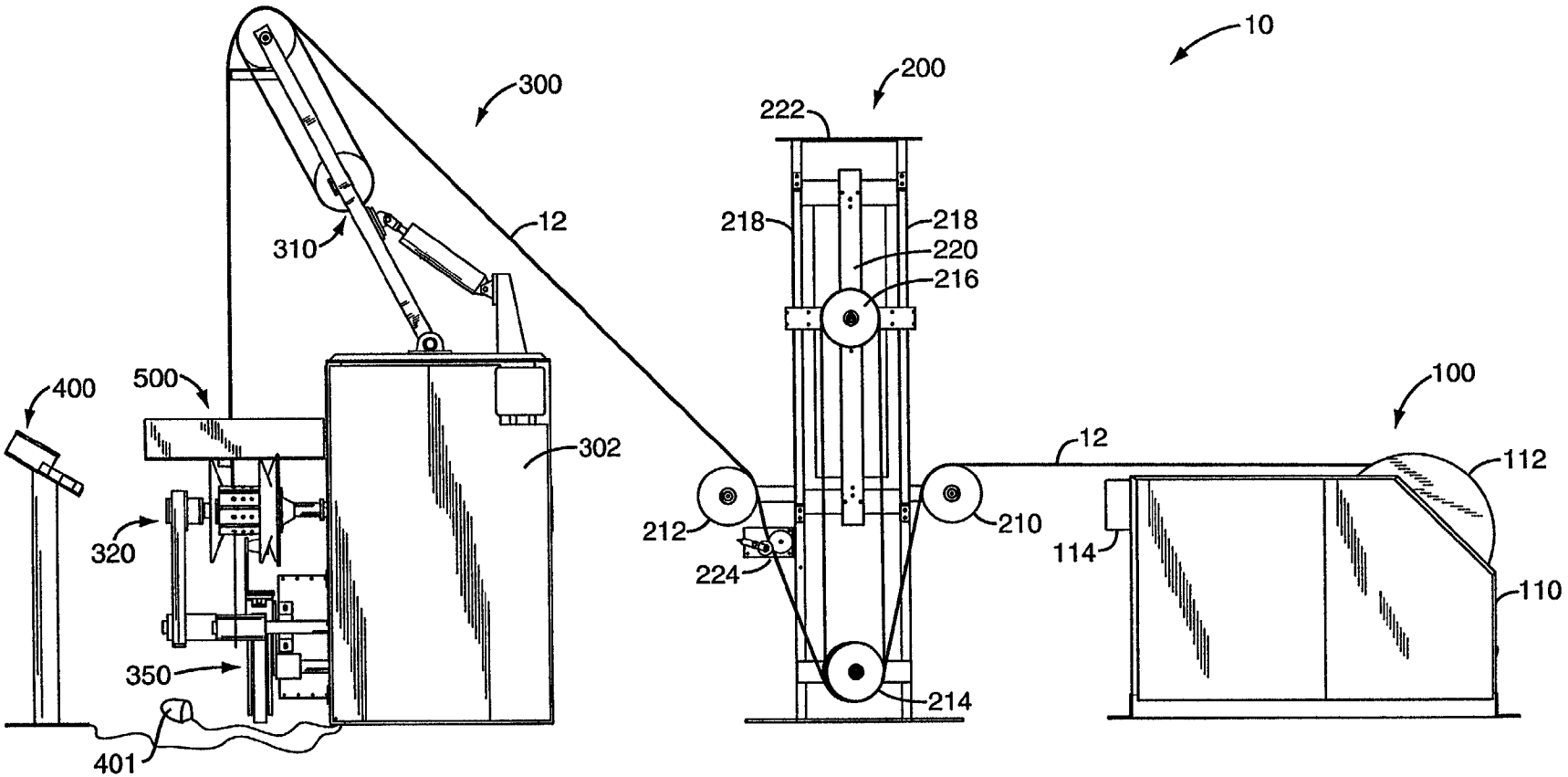
FIG. 1 depicts a wire winding operation.

A typical wire winding operation is depicted in FIG. 1, and indicated generally by the numeral 10. The wire winding operation 10 comprises a wire source 100, a wire tension control unit 200, and a wire winding machine 300. Wire or cable 12 is transferred from the wire source 100 to the wire winding machine 300, under the control of wire tension control unit 200. As used herein, the term "wire" means any filamentary material that may be advantageously wound into packages on a wire winding machine 300. Wire 12 may illustratively comprise a wide variety of single- and multiple-conductor insulated electrical wire, co-axial cable, sheathed optical fiber, and the like.

The wire source 100 may comprise a wire feed unit 110, which accepts a large spool 112 containing a stock of wire 12. The wire feed unit 110 rotates the spool 112 to supply wire 12 therefrom under the control of a control unit 114. Alternatively, the wire supply unit 100 may comprise the final stage of a wire manufacturing equipment such as an extruder (not shown), where it is desired to wind the wire 12 directly into packages as part of the wire manufacturer process.

The wire tension control unit 200 acts as an interface or buffer between the wire source 100 and the wire winding machine 300. In one mode, when the wire source 100 comprises wire feed unit 110, the wire tension control unit 200 supplies wire 12 to the wire winding machine 300 at a generally constant, predetermined tension. In this mode, the wire tension interface unit 200 controls the wire feed unit 110 via controller 114, causing it to increase or decrease the speed of wire supply from spool 112 in response to the starting and stopping of wire winding operations on wire winding machine 300. In another mode, wherein the wire supply 100 comprises a wire manufacturing process, with a generally constant output speed of wire 12, the wire tension interface unit 200 controls the winding speed on the wire winding machine 300 in response to the speed of wire supply 100. Unless otherwise indicated, all explanation of the wire winding operation 10 refers to the first mode, wherein the wire supply 100 comprises a wire feed unit 110 under the control of the wire tension interface unit 200.

The wire winding machine 300 receives wire 12 from the tension control interface unit 200, and alternately winds the wire onto two winding mandrels. Upon winding a package on one mandrel, the wire winding machine 300 automatically transfers the wire 12 to the other mandrel, and begins winding a second package, while the first package is removed from the first mandrel by an operator.

Figure 2:
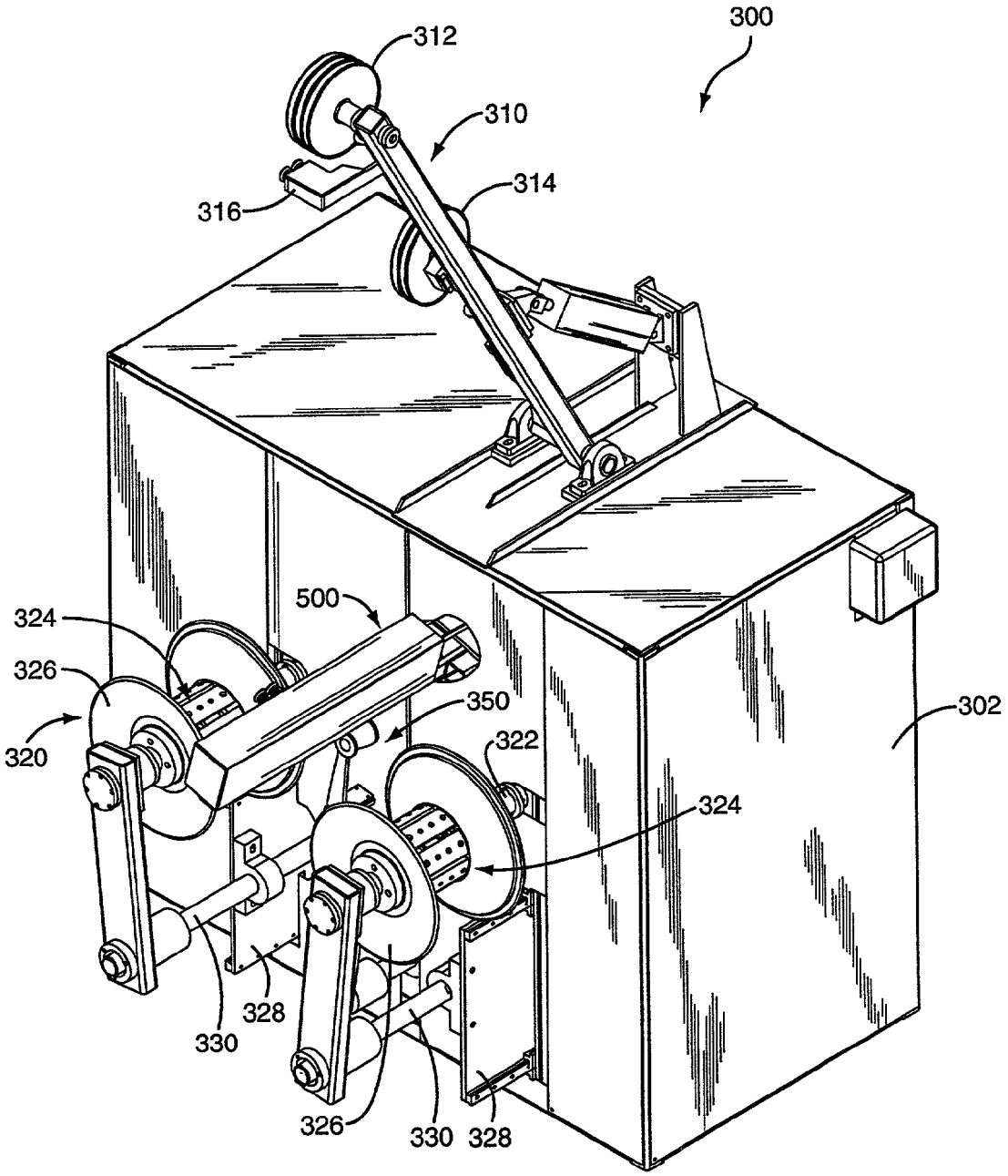
FIG. 2 is a perspective view of the wire winding machine of the present invention.
Figure 3A:
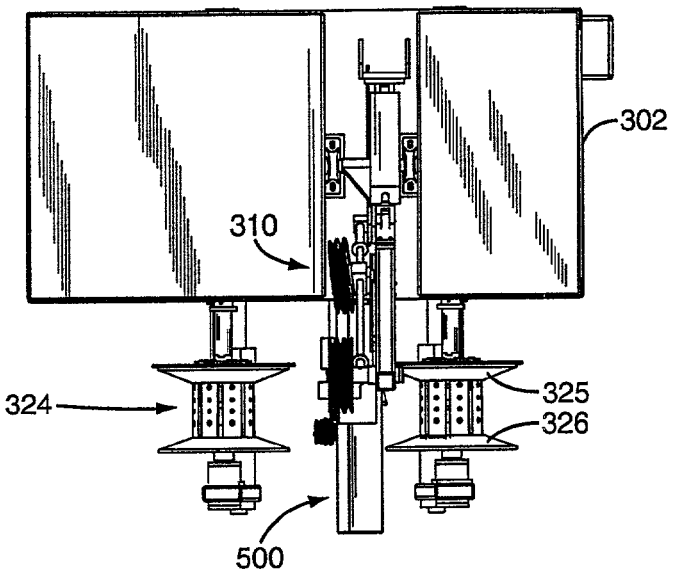
FIGS. 3A and 3B are top and front views, respectively, of the wire winding machine.
Figure 3B:
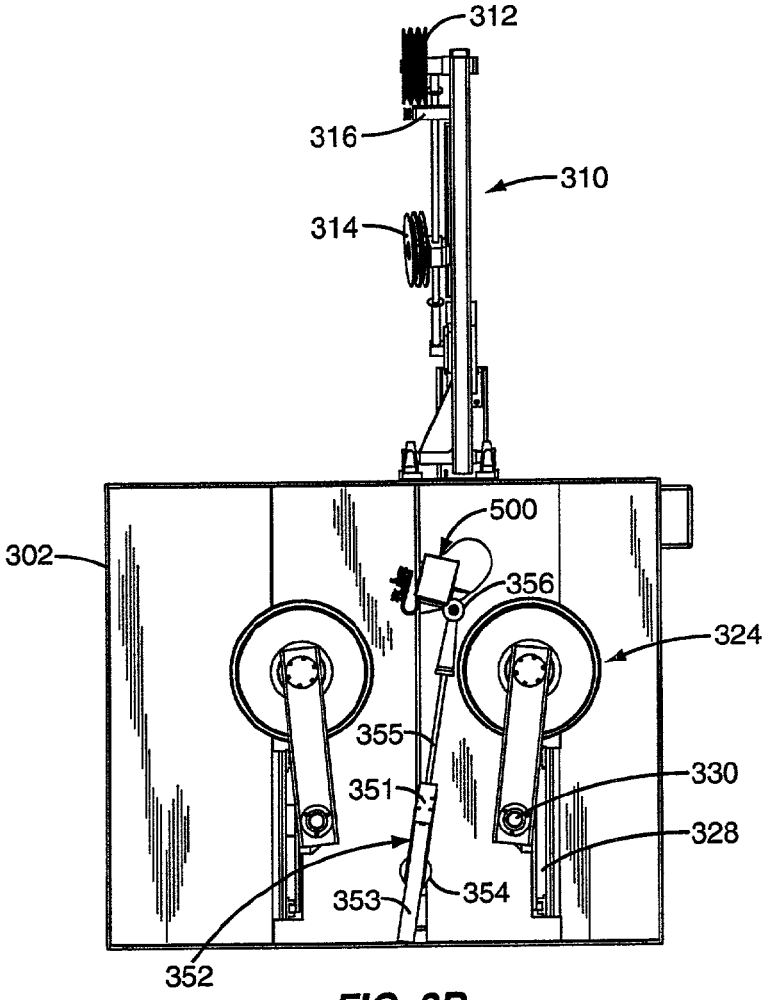

The wire winding machine is depicted in FIGS. 2, 3A, and 3B. The wire winding machine 300 comprises a plurality of interworking subsystems, including a cable tensioner assembly 310, left and right winding head assemblies 320, wire transfer assembly 350, traverse assembly 500, and remote console station 400.

The wire tensioner assembly 310 receives wire 12 and spools the wire 12 between a fixed pulley assembly 312 and a moveable pulley assembly 314, before passing the wire through a tensioner wire guide 316. In operation, perturbations in the tension of wire 12 caused by rapid acceleration and deceleration of the traverse along the winding mandrels (described below), are absorbed by decreasing or increasing, respectively, the amount of wire 12 spooled by the wire tensioner assembly 310 through the motion of moveable pulley assembly 314 relative to fixed pulley assembly 312.

The wire winding machine 300 includes two winding head assemblies 320. For the purposes of discussion, the two winding head assemblies 320 are denominated left and right, as viewed from the front of the housing 302. The two winding head assemblies 320 are mirror images of each other, and operate in the same manner. Where necessary for clarity, a specific one of the winding head assemblies 320 or the subcomponents thereof will be denominated as, e.g., assembly 320-L for the left assembly 320, and assembly 320-R for the right assembly 320.

Each winding head assembly 320 includes a shaft 322, on which is mounted a winding mandrel 324. An inner end cap 325 is affixed to the winding mandrel proximate the housing 302, and an outer end cap 326 is removably affixed to the distal end of the winding mandrel 324. The outer end cap 326 is removed from the mandrel 324 by outward movement of the mounting plate 328. When the mounting plate 328 is extended outwardly from the housing 302, thus disconnecting the outer end cap 326 from the winding mandrel 324, the outer end cap 326 may be rotated in an outward and downward direction by end cap rotation shaft 330, mounted to mounting plate 328. This actuation removes the outer end cap 326 from the front of the winding mandrel 324, allowing access to the package of wire 12 wound thereon. The operation of the outer end cap 326 is described in detail in U.S. Pat. No. 5,499,775, previously incorporated herein by reference.

Wire transfer assembly 350 comprises a single wire transfer arm 352 pivotally mounted to transfer arm shaft 354. See FIG. 6. Affixed to one end of the transfer arm 352, and longitudinally extendable therefrom, is a wire guide 356. The transfer arm 352 and wire guide 356, through rotation and extension/retraction, respectively, operate to transfer wire from a wound mandrel 324 to an unwound mandrel 324.

Figure 7:
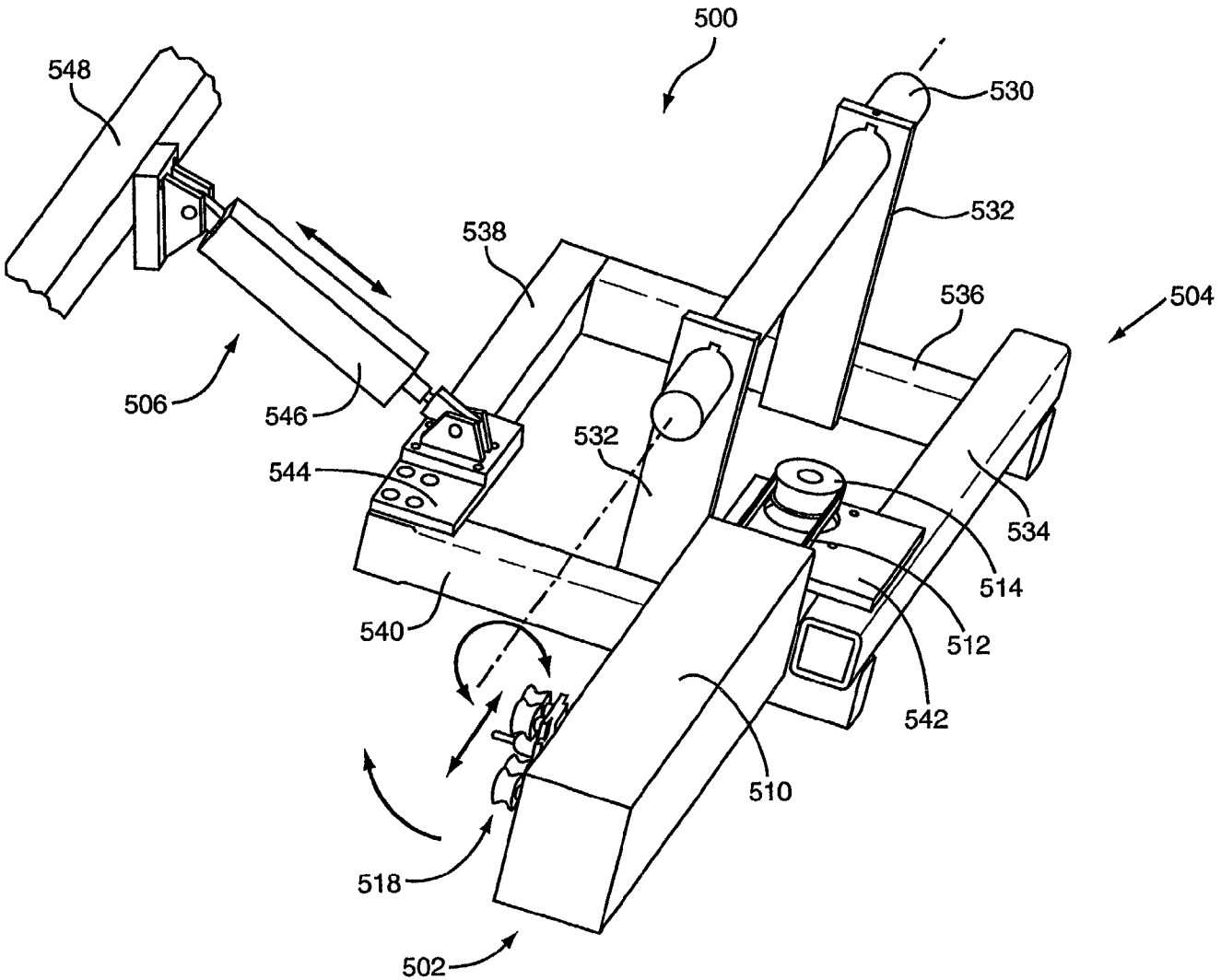
FIG. 7 is a perspective view of the traverse subassembly of the wire winding machine.

The traverse assembly 500 includes a traverse 502 and a mounting frame structure for moving the traverse 502 between first and second positions. The traverse 502 includes a traverse arm 518 that is operative to translate laterally back and forth so as to feed wire 12 onto one of the two wire winding mandrels 324. As explained below, the traverse arm 518, in the embodiment disclosed, comprises a wire directional control device that permits wire or cable 12 to move in only one direction through the control device. The position of the traverse arm 518 with respect to either one of the winding mandrels 324 during a winding operation is directly controlled by a processor or numeric controller, and coordinated with the radial position of the winding mandrel 324 to give rise to a desired wire winding profile. As seen in FIG. 7, the traverse 502 is mounted to a cradle assembly that pivots in a generally arcuate direction, to align the traverse 502 relative to either one of the two winding mandrels 324 for winding wire 12 thereon.

Figure 13:
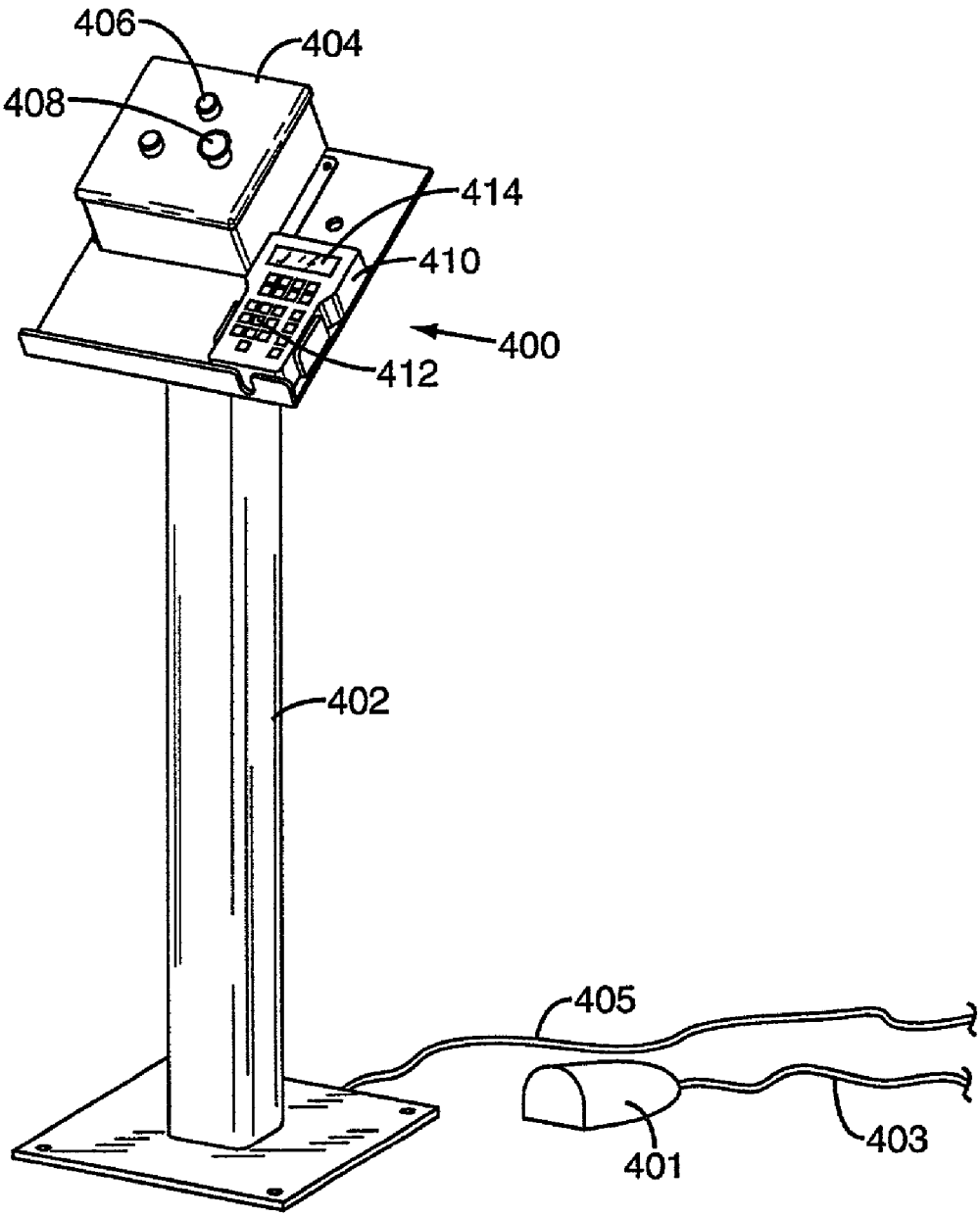
FIG. 13 is a perspective view of the portable operator console and safety interlock of the wire winding machine.

Operator console station 400, depicted in greater detail in FIG. 13, allows for direct control of the operating parameters of wire winding machine 300. Operator console 400 comprises pedestal 402, on which is mounted control panel 404 and remote data terminal 410. A safety interlock, such as a footswitch 401, is also a part of the console station 400. The console station 400 and footswitch 401 are moveably connected to the wire winding machine 300 by a data link, and may be placed in any position convenient or necessary for operation of the wire winding machine 300, as may be dictated by the environment, efficiency, safety concerns, or the like.

The basic operation of the wire winding machine 300—to wind wire onto a winding mandrel 324 in close cooperation with the traverse 502 to achieve a wound package of a particular type and dimension—is described in U.S. Pat. No. 5,499,775, incorporated herein in its entirety. The referenced patent describes the construction and actuation of the winding head assembly 320 and the traverse 502, including the attachment and removal of end cap 326 from winding mandrel 324 via actuation of the mounting plate 328 and end cap rotation shaft 330. These components operate in a directly analogous manner on wire winding machine 300, and are not further explicated herein. In addition, reference is made to the disclosure found in U.S. Pat. No. 5,803,394, the disclosure of which is expressly incorporated herein by reference. Further, as evidenced by the above two patents, it is well known to control the speed of a traverse of a wire winding machine in relationship to the rotational speed of a winding mandrel in order to produce a particular configured wire winding, or package. Therefore, details of the control system and programming for controlling the speed of the traverse and the winding mandrels will not be dealt with herein in detail.

One feature of the present invention is the wire winding machine's ability to transfer wire from a wound mandrel 324 to an unwound mandrel 324 through the rotation and extension of the single transfer arm 352. The wire transfer process will be described with reference to FIGS. 4A–4Q, and the structure and operation of the transfer assembly 350 will be described with reference to FIG. 5.

Figure 4A:
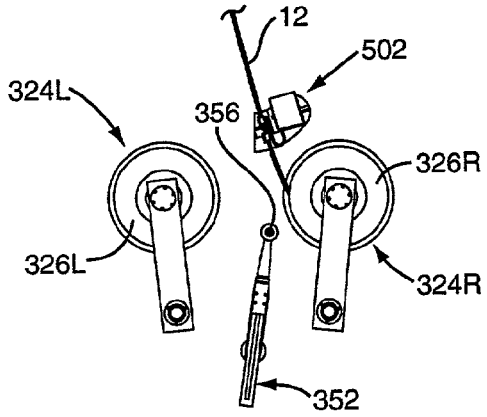
FIGS. 4A–4Q are sequence views that depict the wire transfer operations according to the present invention.

The transfer arm 352 is pivotally mounted to the frame of wire winding machine 300 at a position between and below the axes of rotation of the winding mandrels 324. As depicted in FIG. 4A, the wire winding mandrels 324 are aligned generally horizontally. However, this is not required in the present invention, and in general, the wire winding mandrels 324 may assume any orientation. With this in mind, any reference to "above" or "below" the axes of mandrels 324 refers to lying on wire feed side, or the other side, respectively, of a plane formed by the two axes of rotation. Similarly, the terms "within" and "outside" of the axes, or similar terms of reference, refer to the area between or beyond, respectively, the two planes passing through the axes of the mandrels 324 and perpendicular to the previously described plane containing both axes.

With these definitions in mind, the transfer arm 352 may be described as assuming eight different states—four pivotal positions, with the wire guide 356 assuming a retracted and an extended posture in each position. These eight states and a brief description are summarized in the following table.

TABLE 1

Transfer Arm Position Nomenclature

| Position | Rotational Position of Transfer Arm 352 | Longitudinal Position of Wire Guide 356 |
|---|---|---|
| 1-R | Outside of Right Mandrel 324-R | Retracted |
| 1-E | Outside of Right Mandrel 324-R | Extended |

TABLE 1-continued

Transfer Arm Position Nomenclature

| Position | Rotational Position of Transfer Arm 352 | Longitudinal Position of Wire Guide 356 |
|---|---|---|
| 2-R | Inside of Right Mandrel 324-R | Retracted |
| 2-E | Inside of Right Mandrel 324-R | Extended |
| 3-R | Inside of Left Mandrel 324-L | Retracted |
| 3-E | Inside of Left Mandrel 324-L | Extended |
| 4-R | Outside of Left Mandrel 324-L | Retracted |
| 4-E | Outside of Left Mandrel 324-L | Extended |

Figure 4B:
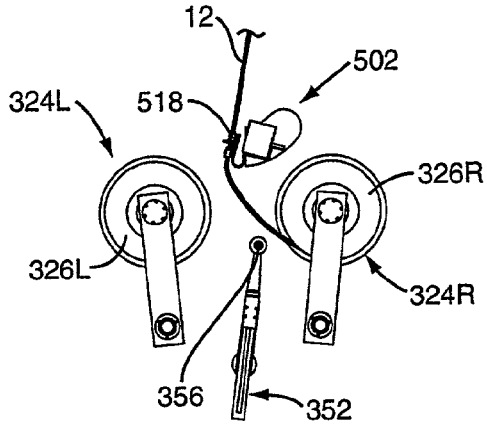
Figure 4C:
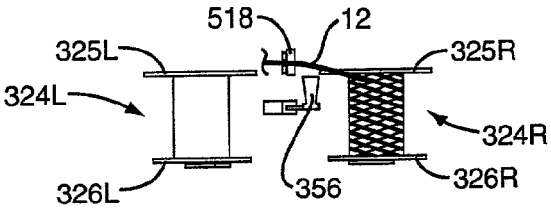
Figure 4D:
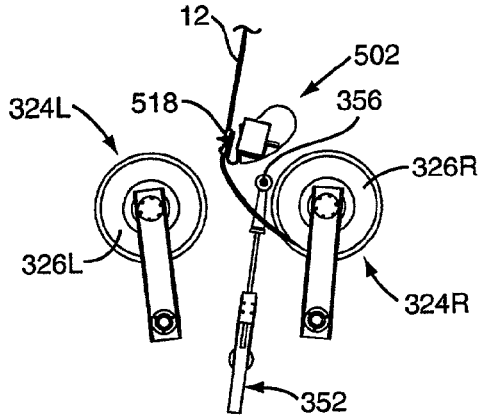
Figure 4E:
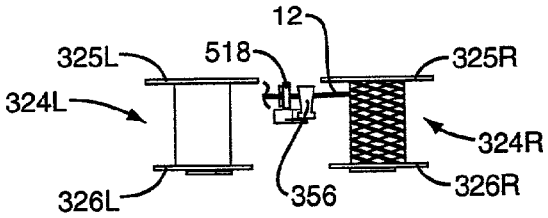
Figure 4F:
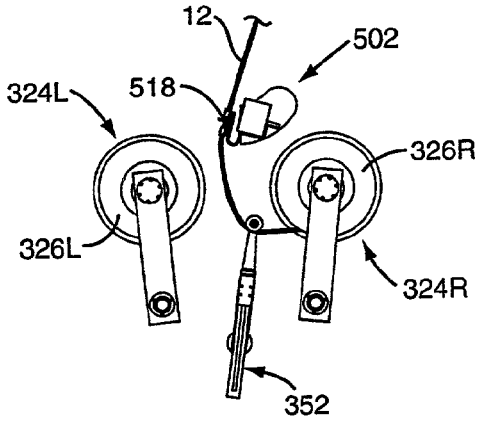
Figure 4G:
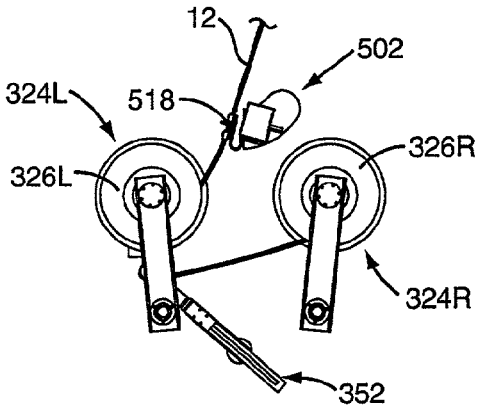
Figure 4H:
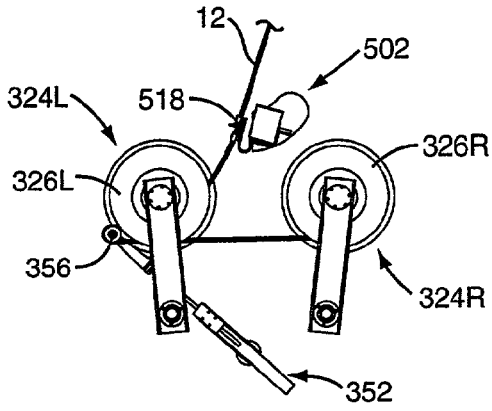
Figure 4I:
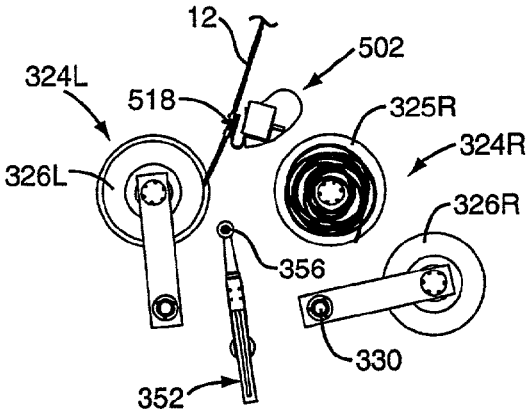
Figure 4J:
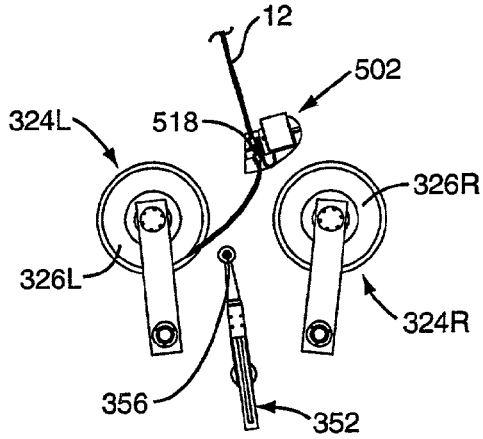
Figure 4K:
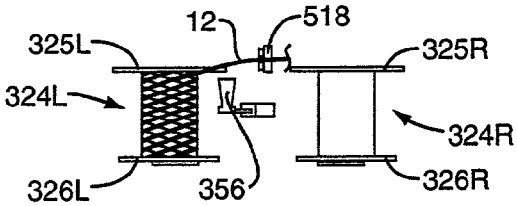
Figure 4L:
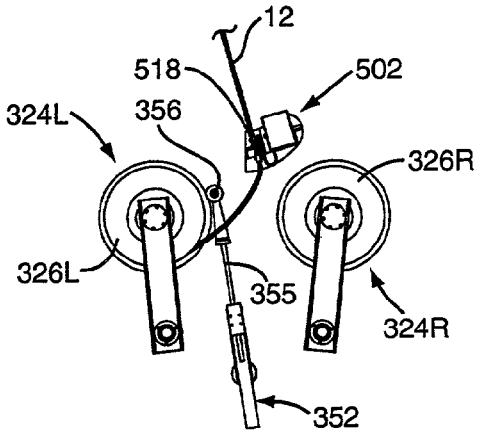
Figure 4M:
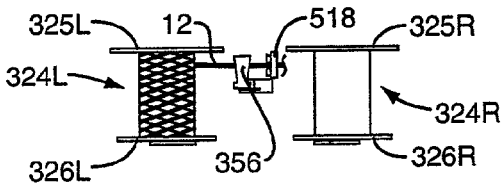
Figure 4N:
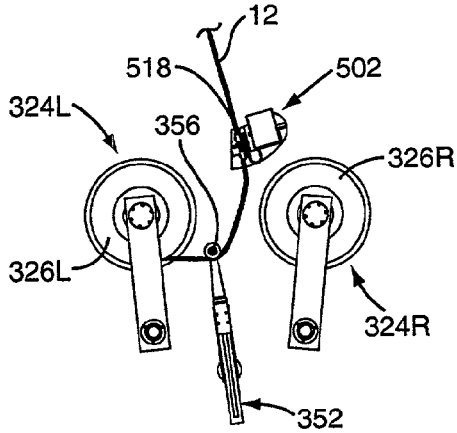
Figure 4O:
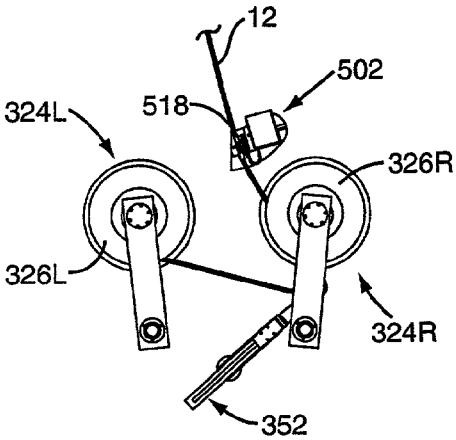
Figure 4P:
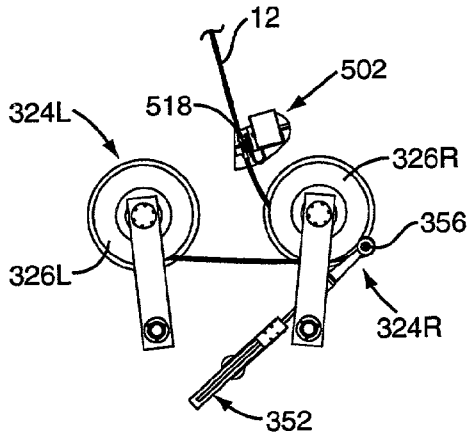
Figure 4Q:
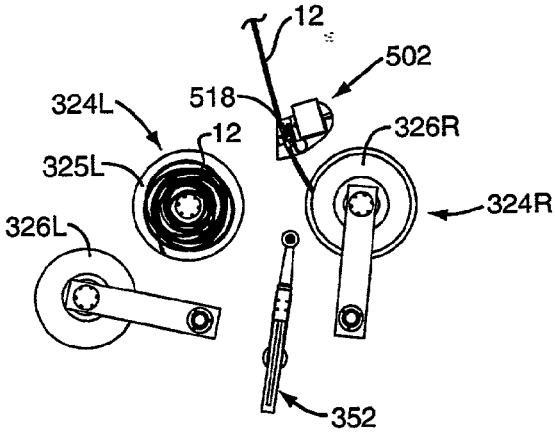

Turning to the sequence of FIGS. 4A–4Q, the operation of the transfer arm 352 in transferring wire from a wound mandrel 324 to an unwound mandrel 324 is described. FIG. 4A depicts the state of the wire winding machine 300 at the completion of winding a package of wire 12 on the right mandrel 324-R. Note that the traverse 502 is positioned adjacent the right mandrel 324-R, with the traverse arm 518 positioning the wire 12 for proper winding on mandrel 324-R. Although the left mandrel end cap 326-L is shown positioned over the left mandrel 324-L, the end cap 326-L is not attached to the mandrel 324-L, as will be explained more fully below.

As shown in FIG. 4B, upon completion of winding a package on mandrel 324-R, the traverse frame 504 actuates to position the traverse 502 in a position for winding wire 12 onto the left mandrel 324-L. The transfer arm 352 is placed in position 2-R.

FIG. 4C is a top plan view depicting the traverse arm 518 having translated the wire 12 toward the housing 302 of the wire winding machine 300, clearing a path for the extension of the transfer arm wire guide 356.

FIG. 4D depicts the transfer arm 352 in position 2-E, with the wire guide 356 extended.

The traverse arm 518 then translates the wire 12 to a position beneath the now-extended wire guide 356, as depicted in FIG. 4-E.

In FIG. 4F, the transfer arm 352 retracts the wire guide 356, placing the transfer arm 352 in position 2-R, and hooking the wire 12.

In the retracted position, the transfer arm 352 then rotates beneath the unwound left mandrel 324-L, to the position 4-R, as depicted in FIG. 4G.

The wire guide 356 once more extends from the transfer arm 352, assuming position 4-E, as depicted in FIG. 4H. This places the wire segment attached to the wire guide 356 against the mandrel 324-L in a position that lies generally between the 6 o'clock and 9 o'clock radial positions of mandrel 324-L. As described more fully below, placing the wire 12 in this position inserts the wire 12 into the open jaws of a cutting and clamping assembly integral to mandrel 324-L. The cutting and clamping assembly is actuated by left mandrel end cap 326-L being attached to the left mandrel 324-L, through actuation of the left mounting plate 328-L in the direction of housing 302 (see FIG. 2). Actuation of the cutting and clamping assembly securely clamps the wire 12 to the left mandrel 324-L, and simultaneously cuts the wire 12.

The wound right mandrel 324-R rotates through a few additional turns to take up the tail-end segment of wire 12. The right mandrel end cap 326-R is then actuated outwardly, away from the wire winding machine frame 302, and then rotates outwardly and downwardly, exposing the wound package of wire 12 on mandrel 324-R, as shown in FIG. 4I. The transfer arm 352 retracts wire guide 356 and rotates to position 3-R. The winding of a new package of wire 12 proceeds on mandrel 324-L, as an operator removes the wound package of wire 12 from mandrel 324-R. When the wound package is removed and the operator has safely cleared the area, a safety interlock such as the foot switch 401 of control console 400 is actuated, indicating that the right end cap 326-R may be rotated back into position adjacent the right mandrel 324-R. The right end cap 326-R is not yet attached to the mandrel 324-R, however, until the wire 12 has been transferred from the wound left mandrel 324-L and placed in a position for clamping and cutting. Winding of a new package of wire 12 proceeds on the left mandrel 324-L.

Upon completion of the winding on mandrel 324-L, the wire 12 is transferred to the right mandrel 324-R in an analogous manner. Specifically, the traverse arm 352 is moved to a position adjacent the right mandrel 324-R and the transfer arm 352 assumes position 3-R, as depicted in FIG. 4J. The traverse arm 518 then retracts adjacent the frame 302, clear of the wire guide 356, as depicted in FIG. 4K. In FIG. 4L, the transfer arm 352 assumes position 3-E, with the wire guide 356 extended. The traverse arm 518 then translates the wire 12 to a position adjacent the winding on left mandrel 324-L and beneath the extended wire guide 356, as shown in FIG. 4M. FIG. 4N shows the transfer arm 352 retracting the wire guide 356, assuming position 3-R, and in the process hooking the wire 12. The transfer arm 352 next rotates to position 1-R, as depicted in FIG. 4O.

The transfer arm 352 then extends the wire guide 356, assuming position 1-E, as shown in FIG. 4P. This places the wire segment leading from the traverse arm 518 against the cutting and clamping jaws of the right mandrel 324-R, in a position generally between the 3 o'clock and 6 o'clock positions of mandrel 324-R. The right mandrel end cap 326-R is attached to the right mandrel 324-R by movement of the right mounting plate 328-R, actuating the cutting and clamping mechanism to cut and clamp the wire 12 securely in the right mandrel 324-R. The left mandrel 324-L then rotates to take up the tail segment of wire 12, and the left end cap 326-L disconnects from the left mandrel 324-L and rotates outwardly and downwardly, exposing the wound package of wire 12 on the left mandrel 324-L for removal by an operator. This is depicted in FIG. 4Q, which additionally shows the transfer arm 352 having assumed position 2-R, in preparation for transfer of the wire from mandrel 324-R to 324-L.

Figure 5:
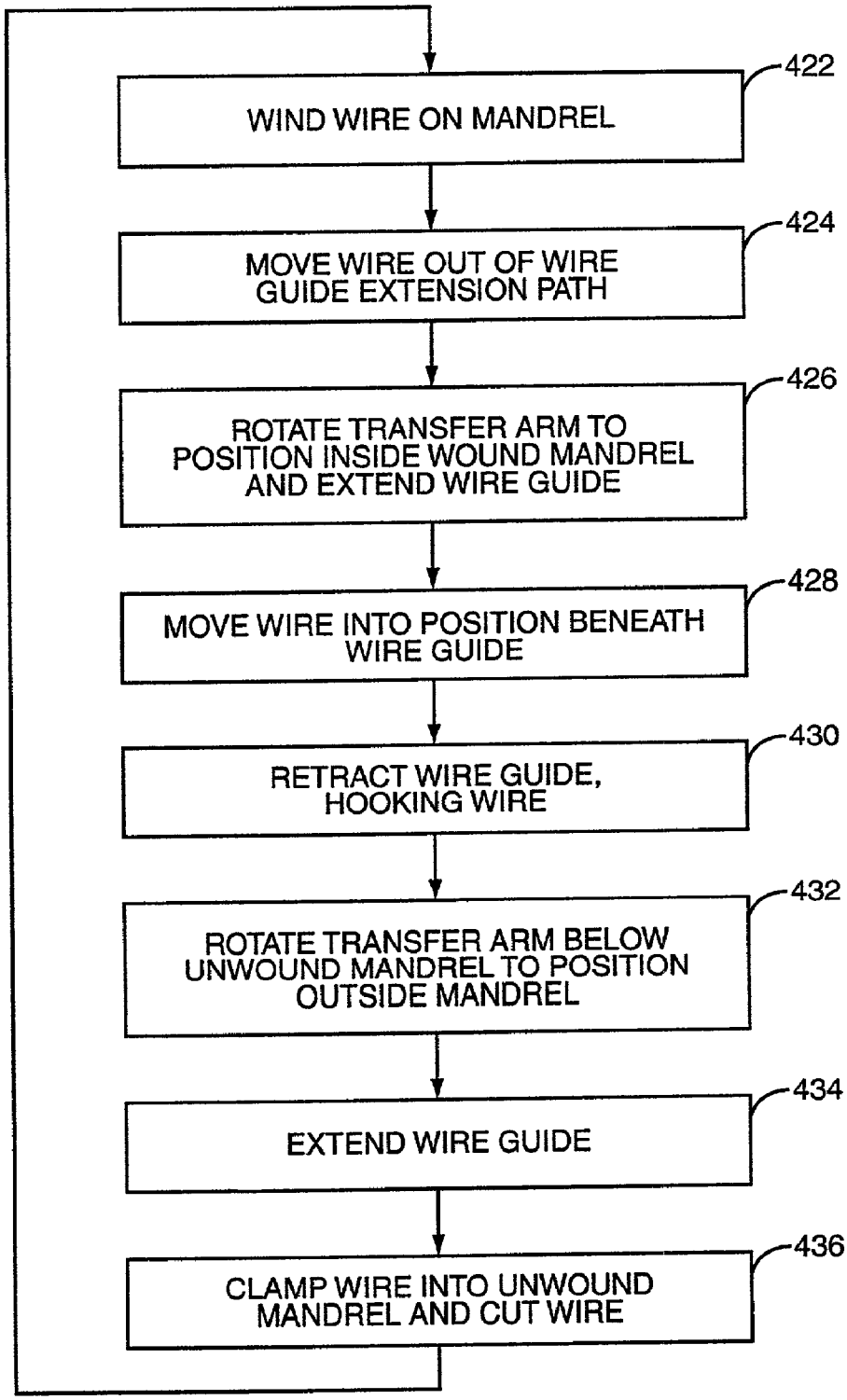
FIG. 5 is a flowchart depicting the steps of the wire transfer procedure.

The process or method of transferring wire between mandrels 324 is depicted in FIG. 5. First, wire 12 is wound on one mandrel 324 (step 422). Next, the wire 12 being fed to the wound mandrel 324 is moved out of the extension path of the wire guide 356 (step 424).

The transfer arm 352 is rotated to a position inside the wound mandrel 324, and the wire guide 356 is extended (step 426). The wire 12 is then moved into position beneath the wire guide 356 (step 428). Next, the wire guide 356 is retracted, hooking the wire 12 (step 430). The transfer arm 352, in a retracted position, is rotated beneath the unwound mandrel 324 to a position outside of the unwound mandrel 324 (step 432). The wire guide 356 is again extended (step 434), positioning the wire 12 adjacent a clamping and cutting mechanism integral to the unwound mandrel 324. The unwound mandrel 324 then clamps the wire 12 and cuts it (step 436), and proceeds to wind a new package of wire 12 (step 422).

Figure 6:
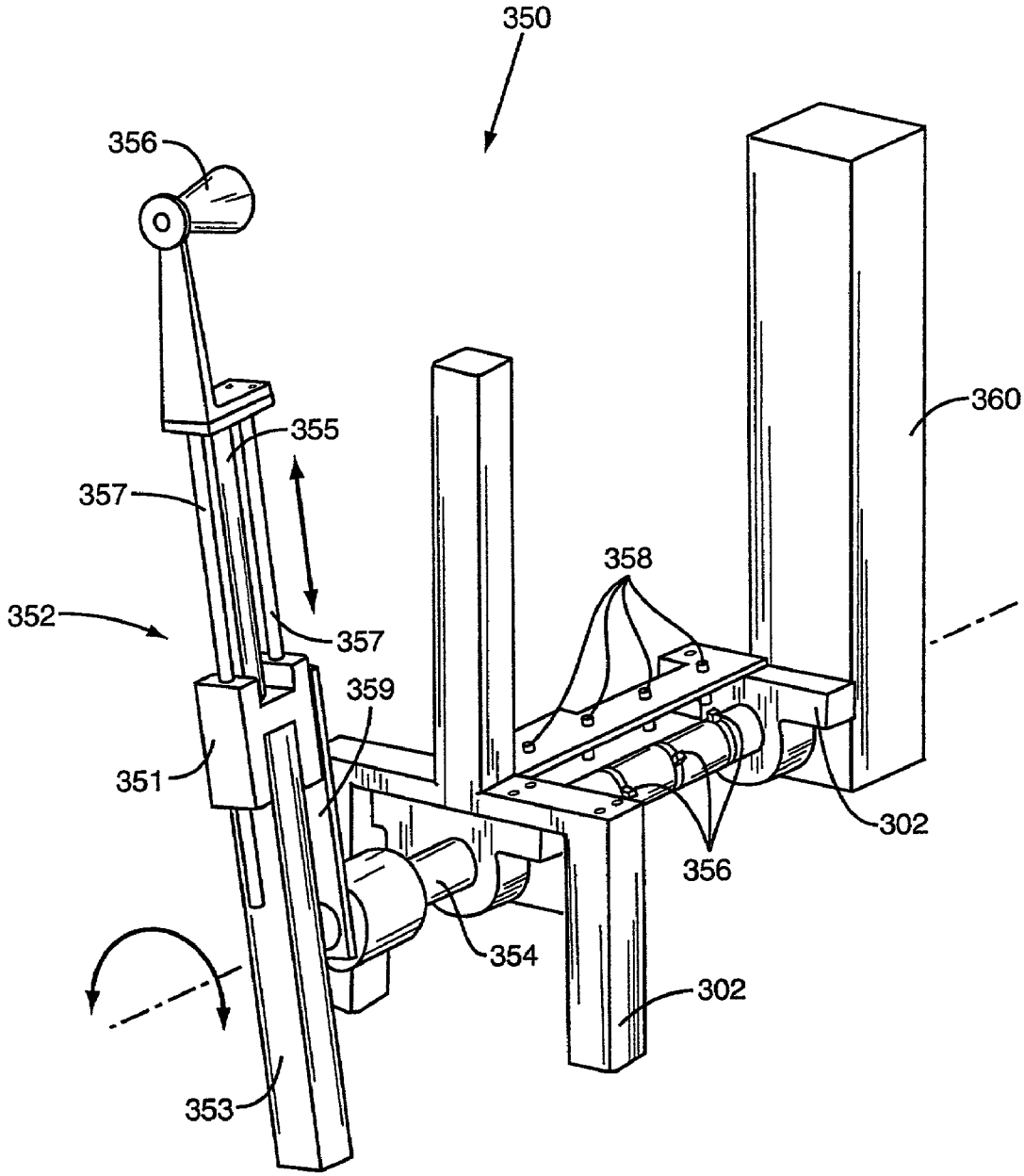
FIG. 6 is a perspective view of the transfer arm subassembly of the wire winding machine.

The structure and operation of transfer arm assembly 350 is described with reference to FIG. 6. Transfer arm 352 is pivotally attached to shaft 354. Shaft 354 is driven by actuator 360, and is held by bearings (not shown) to members of the wire winding machine housing 302. The shaft 354 rotates through some 140 degrees of rotation between positions one through four, as previously described. Actuator 360 is, in one embodiment, a vertically oriented reciprocating pneumatic cylinder and piston device, imparting rotational force to shaft 354 through an appropriate coupling mechanism, such as for example a rack and gear arrangement (not shown). Four position indicators 361, comprising metallic protrusions, are affixed to the shaft 354 on radially adjustable collars. A corresponding array of four positions sensors 358, comprising magnetic detectors, are disposed proximate to the shaft 354, and aligned with the position indicators 361. As the shaft 354 rotates, the position sensors 358, triggered by the corresponding position indicators 361, generate electrical signals indicative of the position of the transfer arm 352. The position indicators 361 and position sensors 358 thus act as "limit switches" indicating to a processor or numeric controller the extent of rotation of the shaft 354 and hence the position of the transfer arm 352.

A wire guide 356 is extendably attached to the transfer arm 352 by wire guide extension shaft 355, and maintained in alignment by guide rods 357. The two guide rods 357 pass through corresponding bores in alignment block 351, which is in turn secured to the shaft 355 by a connecting plate 259. Wire guide extension shaft 355 is attached to a reciprocal linear actuator 353, such as a pneumatic cylinder and piston device. The extension and retraction of wire guide 356 is independent of the rotation of the transfer arm 352, although both are controlled by a processor or numeric controller. Through rotation of shaft 354 and extension and retraction of actuator 353, the transfer arm 356 may assume all of the eight states described in Table 1 above.

Turning now to a description of the traverse assembly 500, and with particular references to FIG. 7, the traverse assembly 500 includes a traverse indicated generally by the numeral 502 and a supporting frame indicated generally by the numeral 504. Interconnected between the frame 504 and the frame structure of the wire winding machine is an actuator indicated generally by the numeral 506.

As will be explained below, the wire winding machine 300 is programmed such that the traverse 502 moves between two positions. This movement occurs during each transfer of the wire or cable 12 from one mandrel 324 to the other mandrel. As used herein, the term "mandrel" is used interchangeably with "winding head" or "winding head assembly". More particularly, the programmable controller 452 (see FIG. 14) is programmed to move the traverse between the two positions after each winding has been completed on a respective mandrel. As will be understood from subsequent portions of the disclosure, the traverse in moving between these two positions, moves in an generally curved or arcuate path.

Referring to the traverse 502, the same includes a housing 510. Contained partially within the housing is a belt drive that includes a belt 512 that is trained about one end around a pulley 514 and about the opposite end by an idler pulley, not shown. Pulley 514 is rotatably supported within the frame 504 and is connected to the output shaft of a servomotor (not shown).

Details of the traverse 502 are not dealt with herein in detail because such structure and operation is well known in the art. For a more complete and unified understanding of a typical traverse mechanism, one is referred to the disclosure found in U.S. Pat. No. 5,499,775, which as noted above, is expressly incorporated herein by reference. Briefly, however, traverse 502 includes an oscillating traverse arm (not shown). The oscillating traverse arm is connected to and driven by the belt 512 and is further stabilized by a guide structure contained within the housing 510. In the embodiment disclosed herein, the traverse arm carries a wire directional control device that is indicated generally by the numeral 518 and shown specifically in FIGS. 8A and 8B. As will be described later in more detail, wire is fed through the wire directional control device 518 and to one of the two mandrels 324. The servomotor (not shown) is controlled by a programmable controller 452 (see FIG. 14). During operation, the servomotor (not shown) receives periodic control signals from the controller 452 and continues to position the wire directional control device 518 at certain programmed command positions. Effectively, the programmable controller 452 controls the traversing of the wire directional control device 518 in relationship to the rotation of each of the mandrels 324 such that the wire or cable being wound is wound according to a programmed configuration.

The traverse 502 is mounted in cantilever fashion to the frame 504. This is illustrated in FIG. 7. Viewing the frame 504 in more detail, it is seen that the same includes a shaft 530, the shaft being mounted within pillow block bearings (not shown) that are in turn supported by an internal frame structure that forms a part of the wire winding machine 300. Suspended from the shaft 530 is a pair of depending swing arms 532. In particular, the swing arms 532 are fixed to the shaft 530 and extend therefrom to where they connect to a rectangular or square frame structure. The rectangular or square frame structure includes a series of members connected together in either a square or rectangular configuration. As used herein, the term "rectangular configuration" may mean that the members form a rectangle or a square. In any event, this frame structure includes members 534, 536, 538 and 540. As seen in FIG. 7, these members are generally connected together about opposed end portions by wellment or other suitable securing means.

In the case of the embodiment illustrated in FIG. 7, the traverse 502 is supported in cantilever fashion from member 540. Further, a mounting plate 542 is secured to member 534 and projects inwardly therefrom. Mounting plate 542 is adapted to support pulley 514 and the servomotor 516 (not shown). Another mounting plate 544 is also mounted to the frame 504. The actuator 506 in the case of the embodiment illustrated in FIG. 7 includes a double-acting pneumatic cylinder 546. Pneumatic cylinder 546 is anchored between mounted plate 544 and a frame member 548 that forms a part of the internal frame structure of the wire-winding machine 300.

Figure 14:
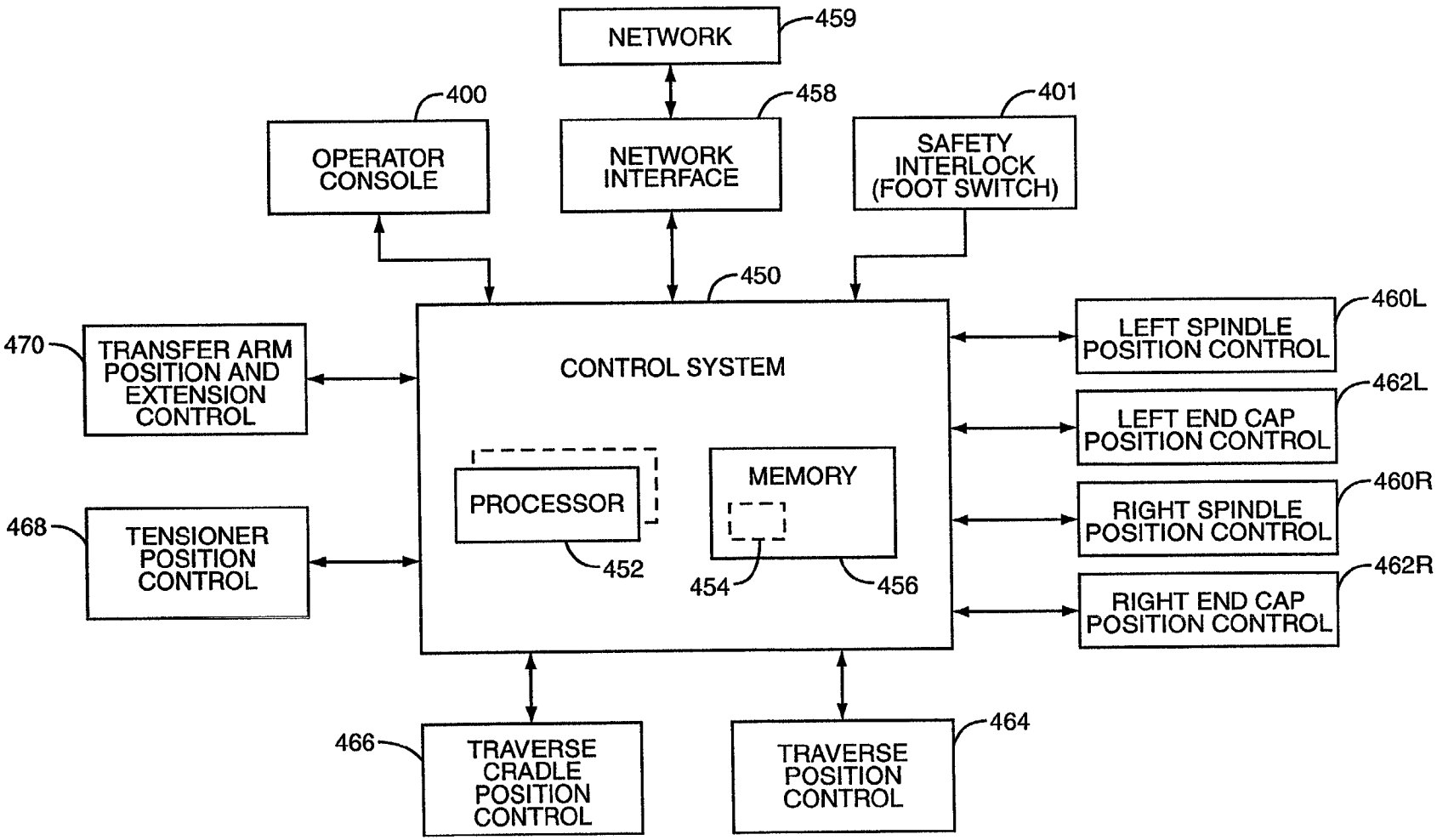
FIG. 14 is a functional block diagram of the wire winding machine.

Pneumatic cylinder 546 is again controlled by the programmable controller 452 (see FIG. 14). At a selected time, the pneumatic cylinder 546 is actuated causing the frame 504 to swing about the axis of shaft 530. Since the pneumatic cylinder is a double-acting pneumatic cylinder, it follows that the frame 504 can be moved back and forth between two positions by the actuation of the pneumatic cylinder 546. Because of the structure of the frame 504 and the fact that the frame swings about the axis of shaft 530, it follows that the traverse 502 in moving between the first and second positions, moves in a curved or arcuate path.

Figure 8A:
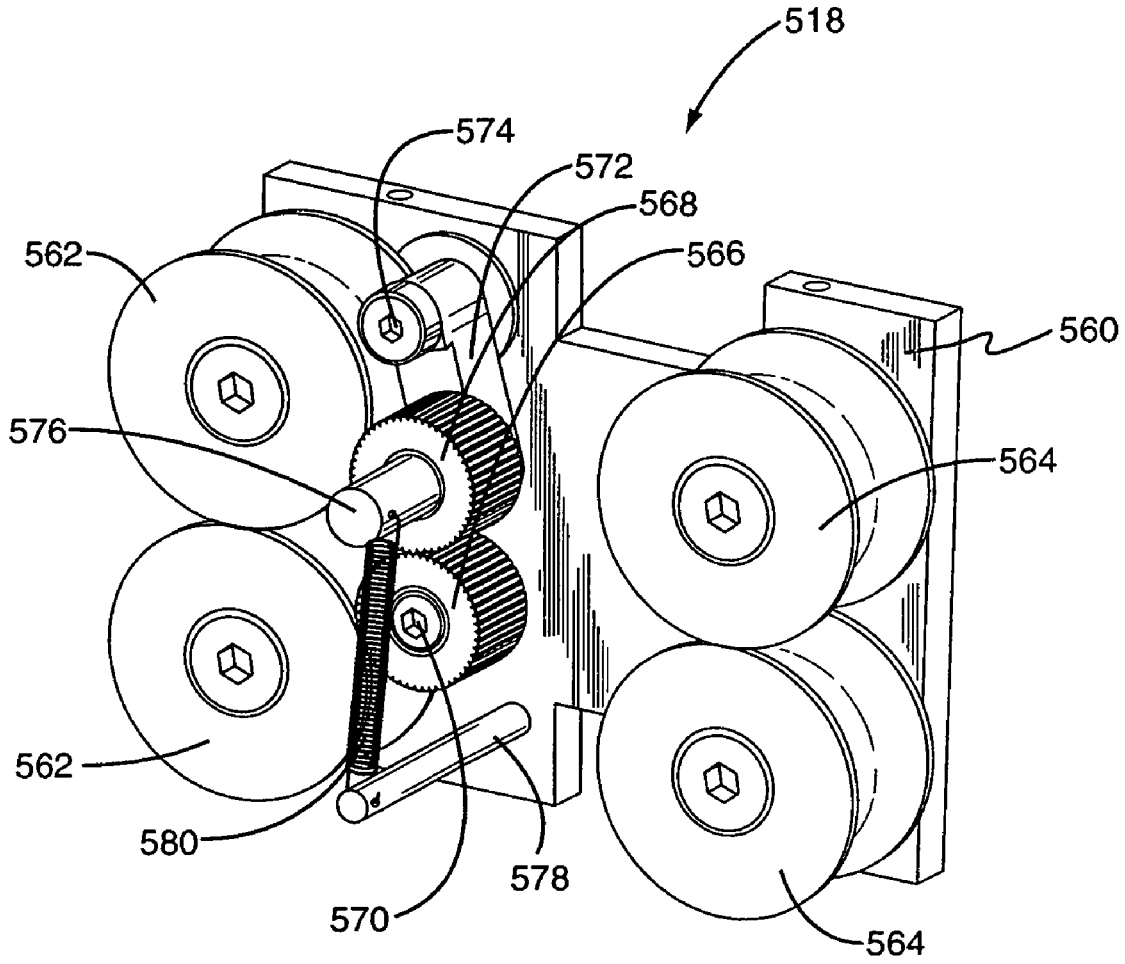
FIG. 8A is a perspective view of the directional control device of the wire winding machine.
Figure 8B:
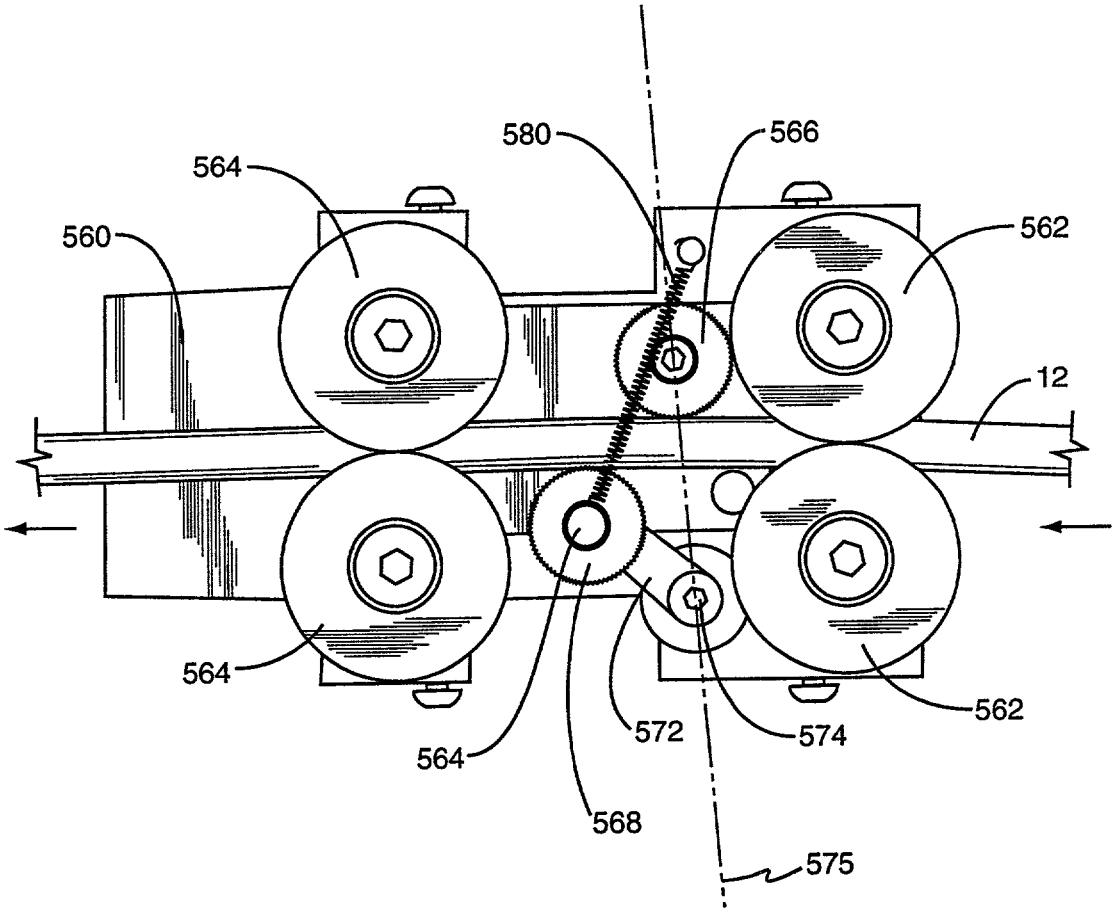
FIG. 8B is a front or plan view of the directional control device of the wire winding machine.

With reference to FIGS. 8A and 8B and the wire directional control device 518, it is appreciated that the wire directional control device is mounted on the traverse 502 and oscillates back and forth therewith while a wire or cable 12 is being wound on one of the particular mandrels 320. Prior to describing the structure of the device 518 it should be noted that the purpose of the device is to guide or direct wire or cable 12 from the traverse 502 to one of the underlying mandrels 320. Thus, the wire as viewed in FIG. 8B generally moves through the wire directional control device 518 in the direction indicated by the arrow. As will be appreciated from subsequent portions of this disclosure, the wire directional control device 518 is provided with a feature that allows wire or cable 12 to freely flow in one direction through the device but acts to prohibit or restrict the movement of wire in the opposite or reverse direction.

Turning to the structure of the wire directional control device 518 it is seen in FIGS. 8A and 8B, that the same includes a plate or frame structure 560. Mounted on the inlet side of the plate 560 is a pair of inlet idler rollers 562. The idler rollers 562 are spaced such that a wire or cable 12 can be fed therebetween. Likewise, mounted on the opposite end or side of the frame 560 is a pair of outlet rollers 564. Outlet rollers 564 are spaced such that the wire or cable 12 extending through the device can pass between the rollers.

Mounted on the plate 560 between the inlet side rollers 562 and the outlet side rollers 564 is a pair of control rollers 566 and 568. One of the control rollers, roller 566, is secured to the plate 560 via a pivot pin 570. Thus, control roller 566 is referred to as a fixed roller because it is secured about the fixed axis of the pivot pin 570. It is appreciated, however, that the control roller 566 is not fixed about the axis of the pivot pin 570 as the control roller 566 can freely rotate about the pivot pin 570.

The other control roller 568 is rotatably mounted on a movable arm 572 and is referred to as a moveable roller. In the case of the embodiment illustrated herein, movable arm 572 is pivotally mounted to the plate 560 by a pivot pin 574. Mounted on one end of the movable arm 572 is shaft 576. Control roller 568 is rotatably mounted about the shaft 576.

Secured to the plate or frame 560 is a fixed shaft 578. One end of a spring 580 is secured to the fixed shaft 578 and extends therefrom to where another end of the spring 580 connects to shaft 576. Spring 580 effectively biases the movable control roller 568 towards the fixed control roller 566. In FIG. 8A, it is seen that the spring 580 pulls the arm 572 and movable controller roller 568 to a closed position against the fixed control roller 566. However, as viewed in FIG. 8B, the movable arm 572 may rotate counterclockwise in response to a wire or cable 12 being fed through the device 518 in the direction indicated in FIG. 8B. Thus, the wire or cable threaded through the directional control device 518 is free to move from the inlet side idler rollers 562 through the control rollers 566 and 568 and on through the outlet side rollers 564.

As noted above, the directional control device 518 is designed to allow the wire or cable 12 to move through the device 518 freely in one direction. The direction of free movement is from the inlet idler rollers 562 towards and through the outlet idler rollers 564. Because of the orientation of the movable arm 572 with respect to the fixed control roller 566, movement of the wire or cable 12 in the reverse direction is prohibited. That is, if there is a tendency for the wire or cable 12 to move from the outlet idler rollers 564 towards the inlet rollers 562, then the movable control roller 568 will tend to rotate clockwise as viewed in FIG. 8B and bind the wire or cable 12 between the two control rollers 566 and 568. As seen in FIG. 8B, the movable arm 572 is of such length that the movable control roller 568 is unable to rotate in a clockwise position past the fixed control roller 566. A reference line 575 is drawn through the axis of the fixed roller 566 and the pivot pin 574 that secures the pivot arm 572 to the plate or support structure 560. Because of the orientation of the pivot arm 572 and the moveable roller 568 attached thereto, the moveable roller 568 can only move about the downstream side of the reference line 575. In other words, the moveable roller 568 can never move past the reference line 575 and to an area on the right side of the reference line 575, as viewed in FIG. 8B, which is referred to as an upstream area. This geometry results in the moveable roller 568 engaging the cable or wire 12 and causing a binding or locking action when the cable or wire has a tendency to move in a direction opposite the direction of the arrows shown in FIG. 8B.

Further, each of the control rollers 566 and 568 have an aggressive outer surface that tends to engage and grip the cable or wire 12 passing therethrough especially when the wire or cable tends to move in the reverse direction, that is in a direction from the outlet idler rollers 564 towards the inlet idler rollers 562. In particular, the control rollers 566 and 568 include a series of lines or fine-like gear teeth that tend to engage the cable or wire 12, especially when the cable or wire 12 tends to move in the reverse direction.

Figure 9:
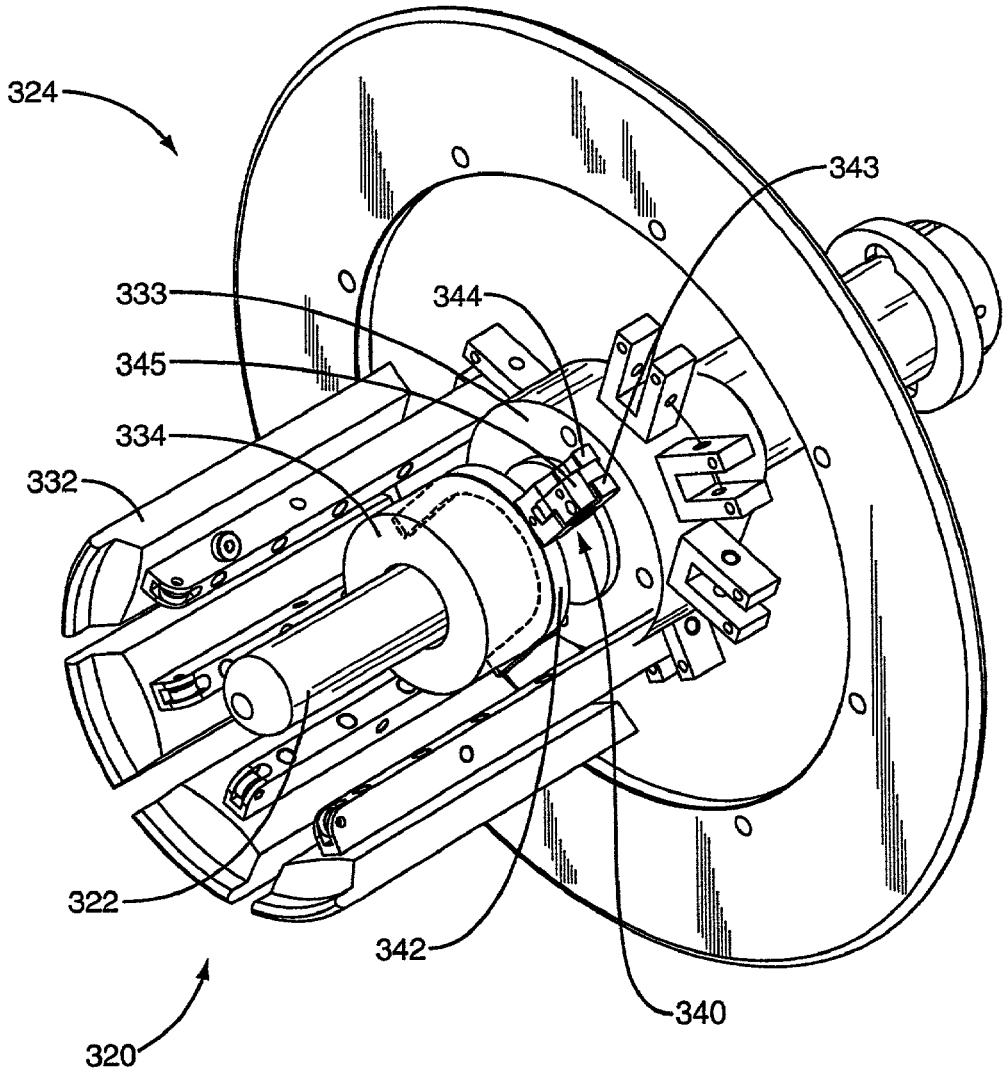
FIG. 9 is a perspective view of a wire winding mandrel, with some of the fingers removed to depict the clamping and cutting mechanism.
Figure 10A:
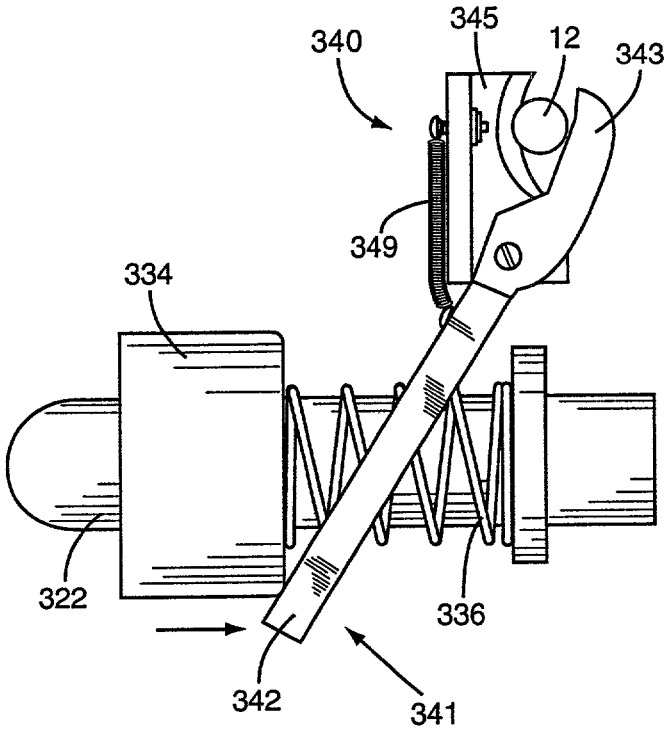
FIGS. 10A and 10B depict diagrammatically the operation of the clamping and cutting mechanism.

The automatic transfer of wire from an unwound to a wound mandrel 324 includes the clamping and cutting of the wire 12 on the unwound mandrel 324, when the wire 12 is positioned adjacent to the unwound mandrel 324 by the transfer arm 352. To accomplish this, the mandrel 324 of the present invention includes an integral clamping and cutting mechanism 340, as depicted in FIGS. 9 and 10A. The clamping and cutting mechanism 340 includes a clamping and cutting lever 341, having a wishbone actuation arm 342 on one end, and a clamping finger 343 and a cutting finger, 344 at the other end. The clamping and cutting lever 341 is pivotally mounted to a fixed block 345, which is attached to the mounting hub 333 of the mandrel 324, as shown in FIG. 9. The wishbone actuation arm 342 extends around the mandrel shaft 322, and in the open position, the clamping and cutting fingers 343, 344 are recessed in a void formed in the mandrel inner end cap 325 (not shown in FIG. 9; see FIGS. 2, 3A).

FIG. 9 shows a perspective view of a mandrel 324, with several of the fingers 332 removed to show the clamping and cutting mechanism 340. The fingers 332 are hingedly attached at one end to a mounting hub 333, on the side of the mandrel 324 opposite the removeable outer end cap 326. The fingers 332 are biased toward a collapsed position, wherein the free end of each finger 332 collapses towards the winding shaft 322 when the outer end cap 326 is removed. Thus, when the outer end cap 326 is removed, the central portion of the winding mandrel 324 assumes a tapered or conical shape. This facilitates the removal of a wound package of wire 12 from the mandrel 324 by an operator. When the outer end cap 326 is attached to the mandrel 324, the fingers 332 are urged outwardly, and the central portion of the mandrel 324 assumes a cylindrical shape.

Figure 10B:
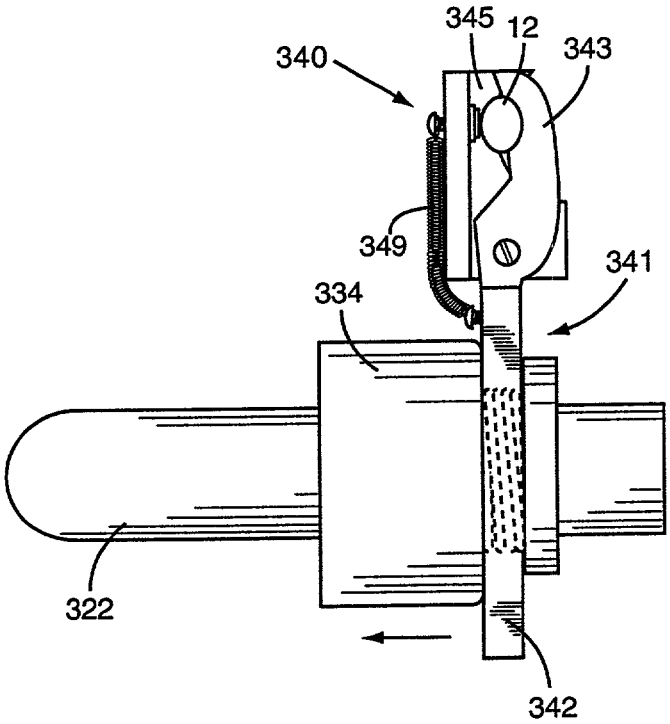

The attachment of the outer end cap 326 to the mandrel 324 additionally moves the spacing collar 334, which is biased towards an outer position by a spring 336, to an inner position. As the spacing collar 334 moves to an inner position on shaft 322, it engages the wishbone actuation arm 342 of the clamping and cutting lever 341, which is positioned around the shaft 322. The actuation of the clamping and cutting mechanism 340 by the spacing collar 334 is depicted in FIGS. 10A and 10B. As the spacing collar 334 engages the wishbone actuation arm 342, the clamping and cutting fingers 343, 344 engage the wire 12 against the fixed block 345, clamping and cutting the wire 12.

Figure 11A:
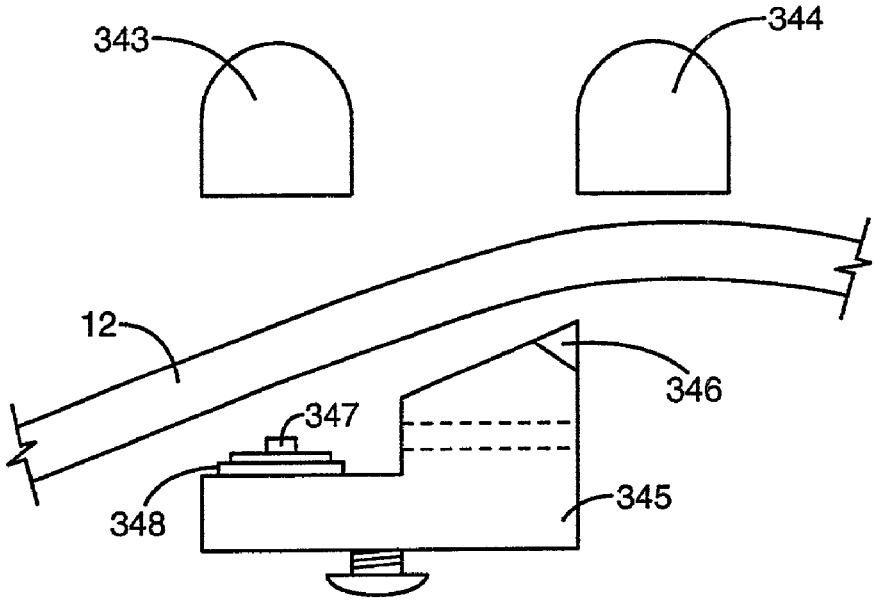
FIGS. 11A and 11B depict diagrammatically the operation of the clamping and cutting fingers.
Figure 11B:
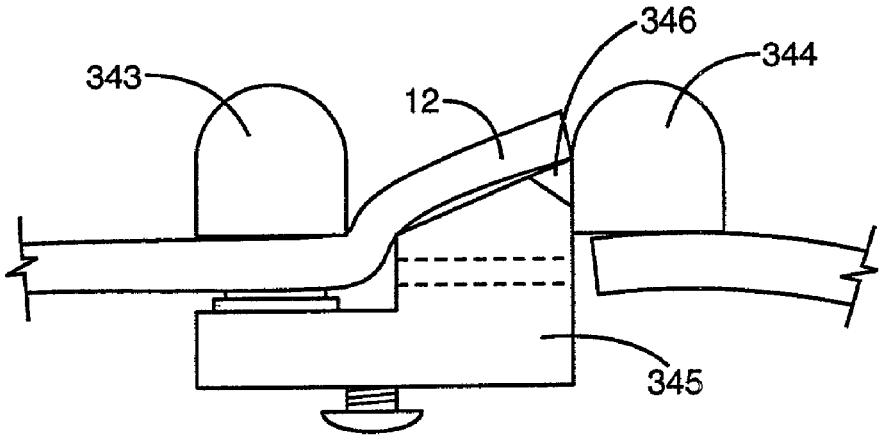

The clamping and cutting action is depicted in FIGS. 11A and 11B. As the clamping finger 343 and cutting finger 344 of the lever 341 move toward the fixed block 345, a wire segment 12 lying between the fingers 343, 344 and the fixed block 345 is pressed against the fixed block 345. The wire 12 is trapped between the clamping finger 343 and the fixed block 345, securely clamping the wire 12. The wire 12 is also forced by the cuffing finger 344 against a cutting surface 346 formed in the fixed block 345. The cuffing finger 344 may additionally include a cutting surface formed in one side, so that the actuation of the cutting finger 344 and the cutting surface 346 of the fixed block 345 cooperate in a scissors-type action to cut the wire 12. A frictional nub 347, carried by an adjustable set screw 348, is disposed on the fixed block 345 opposite the clamping finger 343. The frictional nub 347 presses into the insulation of the wire 12, enhancing the security of the clamping and holding of the wire 12. The set screw 348 is adjustable to place the frictional nub 347 at a variable distance from the fixed block 345, allowing the clamping and cutting mechanism 340 to be adjusted for a wide variety of wire shapes and sizes.

As shown in FIGS. 10A and 10B, a spring 349 biases the clamping and cutting lever 341 to an open position with respect to the fixed block 345 when the mandrel outer end cap 326 is removed and the spacing collar 334 travels to an outward position on shaft 322. In the open position, the clamping and cutting fingers 343, 344 are recessed into the mounting collar 333 of the winding mandrel 324. In this position, any wire 12 clamped between the clamping finger 343 and the fixed block 345 is released, and the clamping and cutting mechanism 340 is ready to receive another segment of wire 12.

Figure 12A:
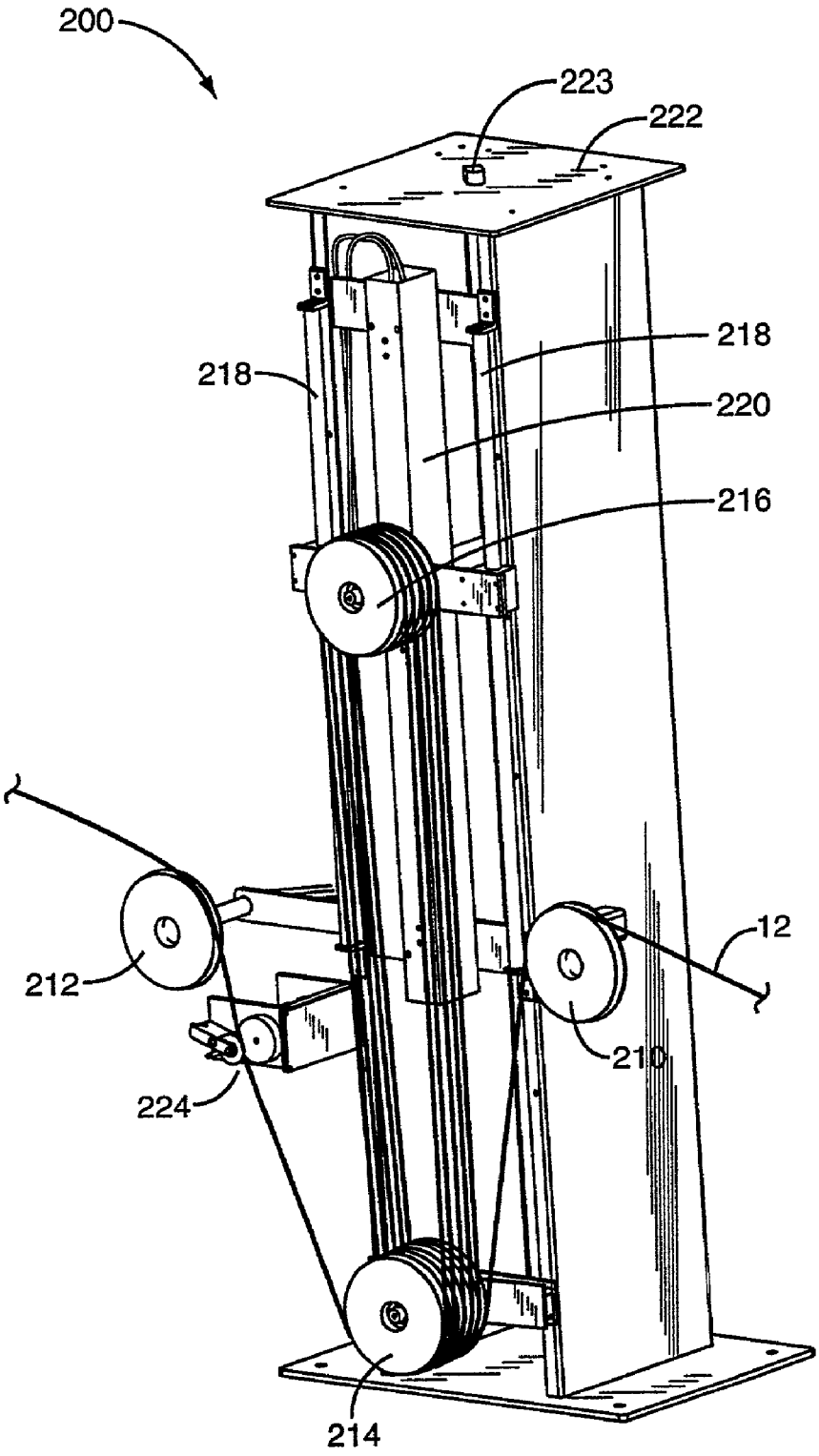
FIG. 12A is a perspective view of the wire tension control unit of the present invention.

The wire tension control unit 200 of the present invention is depicted in FIG. 12. Known in the art as a "dancer" or "accumulator," the tension control unit 200 maintains a predetermined tension on the wire 12 as it is fed to the wire winding machine 300. The wire 12 enters the tension control unit 200 from the wire source 100 by an input pulley 210. The wire 12 is then spooled between a fixed pulley assembly 214 and a movable pulley assembly 216, forming a reservoir of wire 12. The wire 12 then passes through a wire measuring device 224, and exits at exit pulley 212.

The movable pulley assembly 216 is slideably affixed to the wire tension control unit 200 by vertical rails 218. The downward movement of the movable pulley 216 is opposed by air pressure in a pneumatic cylinder 220. The opposing force of the pneumatic cylinder 220 is variable via changes in the pneumatic pressure, and determines the tension to be maintained on the wire 12.

In operation, as the wire winding machine 300 begins winding a package, the wire tension control unit 200 supplies wire 12 at a predetermined tension from the reservoir of wire maintained between pulley assemblies 214 and 216. This forces the moveable pulley assembly 216 to move closer to the fixed pulley assembly 214, as wire 12 is supplied to the winding machine 300 from the reservoir of wire 12 maintained between the pulley assemblies 214, 216. The movement of the movable pulley assembly 216 is detected, and triggers a signal sent to the wire source 100 to increase the pay-out speed of wire 12, such as for example by altering the control voltage supplied to a variable speed motor. As the wire source 100 pays out wire 12 at a rate sufficient to supply the winding machine 300, the movable pulley assembly 216 halts further movement towards the fixed pulley assembly 214. Conversely, as the winding machine 300 completes winding a package, and its demand for wire 12 decreases, excess wire 12 being supplied by the wire source 100 is absorbed in the reservoir of the tension control unit 200 by movement of the movable pulley assembly 216 away from the fixed pulley assembly 214. This movement of the pulley assembly 216 is additionally sensed, and triggers a control signal to the wire source 100 to decrease in its pay-out speed.

Figure 12B:
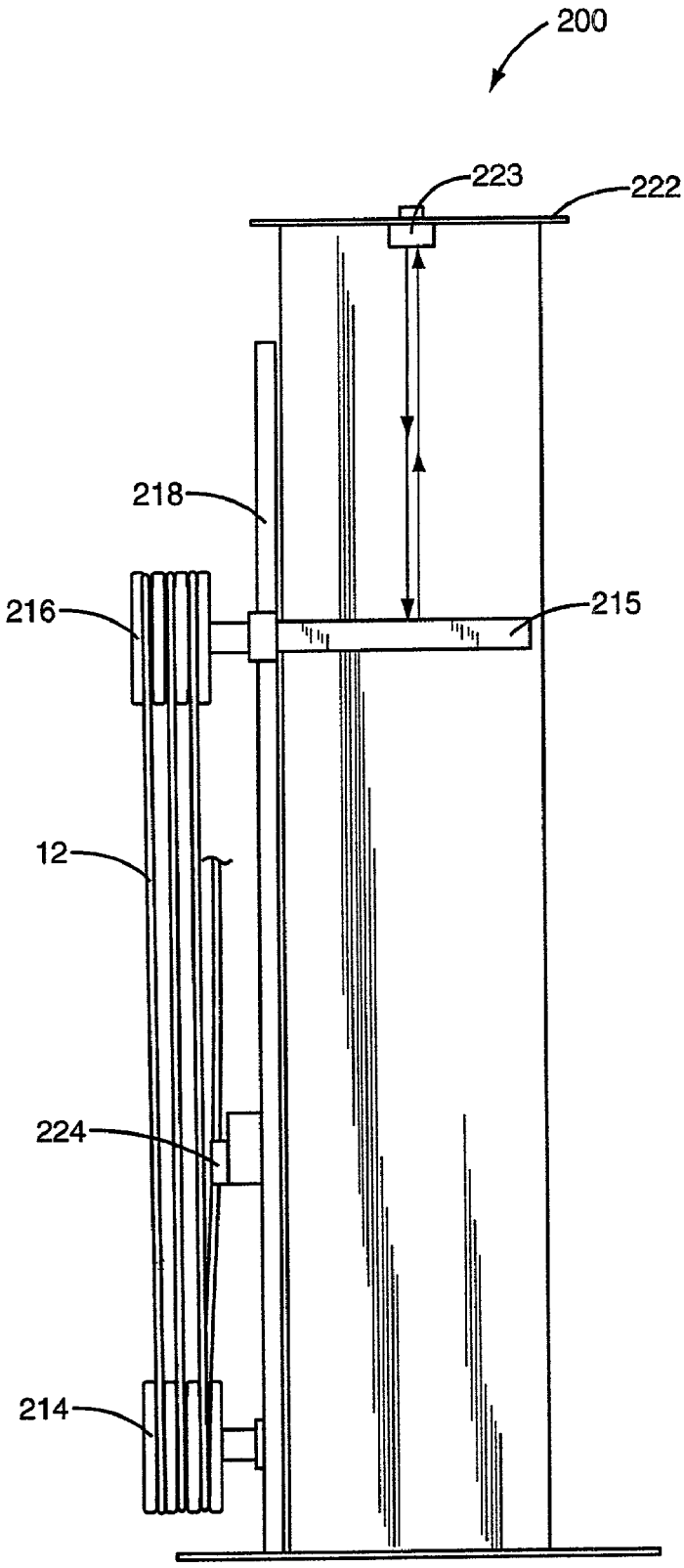
FIG. 12B is a side section view of the wire tension control unit, depicting the operation of the radiated signal distance measuring device.

In prior art implementations of the tension control unit 200, the motion of the movable pulley assembly 216 toward and away from the fixed pulley assembly 214 was sensed mechanically, such as by turning a vertically oriented threaded rod, which in turn would adjust a potentiometer. Such mechanical motion or distance sensing devices suffer from imprecision of measurement, and various mechanical artifacts such as stiction. According to the present invention, the position of the movable pulley assembly 216 is continuously and precisely monitored by a radiated signal distance-measuring device, as shown in FIG. 12B. Ultrasonic source and sensor unit 223 is mounted to the fixed top 222 of the tension control unit 200. The ultrasonic unit 223 radiates an ultrasonic signal oriented downwardly and interior of the housing of the tension control unit 200. The ultrasonic signal is reflected off of a horizontal reflecting plate 215 affixed to the movable pulley assembly 216, and the reflected signal is detected at the ultrasonic unit 223. The travel time of the ultrasonic signal from the source to the reflecting plate and back to the detector is measured, and the distance of the reflecting plate from the fixed top 222 is determined from the known propagation speed of the ultrasonic signal. This distance, and changes thereto as the movable pulley assembly 216 moves, then determine the control signals sent to the wire source 100.

Although FIG. 12B depicts a tension control unit 200 with a distance measuring device having an ultrasonic source and detector co-located in unit 223, and measuring a signal reflected off of a reflecting plate 215, the present invention is not limited to this embodiment. In general, a broad variety of technologies may be employed to generate and detect the radiated signal. The radiated signal may, for example, comprise a laser beam, either a visible light or infrared laser. The laser beam source may comprise a gas discharge tube or a laser Light Emitting Diode (LED). The detector may comprise a photo-diode responsive to the relative frequency of the laser beam, a charge-coupled imaging device, or the like. Alternatively, as described above, the radiated signal may comprise an ultrasonic acoustic signal, with a suitable ultrasonic source and detector. As another example, the radiated signal may comprise a Radio Frequency electromagnetic wave, such as an X or K band radar signal, with the associated source and detector comprising appropriately configured and tuned oscillators, transmitters, receptors, and antennas, as are well known in the art. Particularly for the measurement of small distances, the radiated signal may comprise a magnetic flux, for example generated by an electromagnet and detected by a Hall effect sensor. In general, a wide array of radiated signal measuring devices are known in the art, and may be advantageously adapted to the distance measuring device of the present invention.

Similarly, it is not required that the radiated signal source and detector be co-located, or that the signal be reflected off of the point being measured. For example, either the source or detector may be located on the plate affixed to the moveable pulley assembly 216, and the direct, straight-line travel time of the radiated signal used to calculate the distance. In this configuration, calculation of the distance is simply the measured travel time of the radiated signal from the source detector, multiplied by the known propagation speed of the radiated signal. Mathematically, $$d=t_{travel}*S_{prop}$$

where d=source to detector distance;

$t_{travel}$=travel time of the radiated signal from the source to the detector; and $s_{prop}$=propagation speed of the radiated signal.

In the case of a co-located source and detector and a reflected radiated signal, as depicted in FIG. 12B, the distance is half that described by the above equation. As another example, a reflected signal may be used, but with the source and detector separately located, and not necessarily co-planar with respect to the reflecting surface. In this configuration the distance is calculated by first determining the path length of the radiated signal, denominated as p. The offset of the source and detector, if any, indicated by the quantity $d_{sd}$, is subtracted from the signal path length p (regardless of whether the source or detector is positioned closest to the point being measured). The distance from the closer of the two is then half of the remaining path length. Note that this calculation assumes that the angle ? formed between the incident and reflected radiated signal path is small. In this case, sin ? is negligible, and does not affect the calculation of p as described. For a greater angle ?, one of skill in the art may easily derive distance calculation equations to account for the angle. Mathematically, $$p=t_{travel}*S_{prop}$$

$$d_1 = \frac{p - d_{sd}}{2} \text{ and}$$

$$d_2=d+d_{sd}$$

where p=radiated signal path length from source to detector;

$t_{travel}$=travel time of the radiated signal from the source to the detector;

$s_{prop}$=propagation speed of the radiated signal;

$d_{sd}$=distance of offset between the source and detector in the direction of the point to be measured;

$d_1$=distance between the closer of the source or detector to the point being measured; and $d_2$=distance between the further of the source or detector to the point being measured.

In either case, the distance of the reflecting plate 215, and hence the moveable pulley assembly 216, from the fixed top 222 of the tension control unit 200 is easily translated to the distance between the moveable pulley assembly 216 and the fixed pulley assembly 214 by subtracting it from the known distance between the fixed top 222 and the fixed pulley assembly 214.

The above calculations may be performed by an appropriately programmed digital microprocessor or controller, either integral to the wire tension control unit 200 or located remotely, such as for example the wire winding machine 300 programmable controller 452 (see FIG. 14). Alternatively, the distances may be calculated in a dedicated circuit connected to the radiated signal source and detector, which may, for example, be co-located with the radiated signal source and detector unit 223. Although the above discussion clearly discloses to those of skill in the art how the position of the moveable pulley assembly 216 may be calculated by use of a radiated signal distance measuring system, the actual calculation(s) need not necessarily be performed. For example, an output of the ultrasonic device 223 that is indicative of the measured distance, such as for example a variable voltage, may be used directly (or scaled or otherwise modified, as appropriate) as the control signal sent to the wire supply 100.

A feature of the wire winding machine 300, depicted in FIG. 13, is the provision of a safety interlock 401 and an operator console pedestal 402, both of which are portable, and may be positioned in a convenient manner in the vicinity of the wire winding machine 300. The safety interlock 401, depicted in FIG. 13 as a foot switch enclosed in a protective housing, requires operator input to proceed through various stages of the wire winding operation. Specifically, following the removal of a package from a wire winding mandrel 324, the safety interlock 401 must be actuated. This indicates to the wire winding machine 300 that the mandrel end cap 326 may be rotated into position for attachment to the winding mandrel 324. The safety interlock 401 is connected to the wire winding machine 300 via cable 403. This allows the safety interlock 401 to be located in a position that is convenient to the operator, and conducive to efficient operation of the wire winding machine 300.

The operator console pedestal 402 is also movable to a convenient position, and connected to the wire winding machine 300 by cable 405. The mobility of the operator console station 400 enhances the efficiency and safety of the wire winding operation, by allowing the operator to set up and control the equipment in a convenient manner, rather than permanently locating the various controls on the wire winding machine 300. The control panel 404 is located on the operator console pedestal 402. The control panel 404 includes a START/STOP switch 408, and at least one indicator light 406. When all of the parameters for a wire winding operation have been loaded into the wire winding machine 300, the wire winding operation may proceed, requiring input only at the control panel 404 and the safety interlock 401, with the state of the wire winding machine 300 indicated by the indicator light(s) 406.

A remote data terminal 410 is also located on the operator console pedestal 402. The remote data terminal 410 includes a keypad 412 and a display 414. The remote data terminal 410 is used to load the various operating parameters for a wire winding operation into the wire winding machine 300. These parameters may include, for example, the size or gauge of wire, the length of wire to be wound in each package, the package type or configuration, whether the wire winding machine 300 is to run in constant-velocity or constant-RPM mode, and the like. Prompts for the information are displayed on the display 414, and the parameters are input via the keypad 412, such as by selecting a proffered choice from a menu or entering a numeric value. The remote data terminal 410 as depicted in FIG. 13 is a standard industrial remote data terminal, connected to the wire winding machine via cable 405 and employing a standard data communications interface protocol, such as RS-232, RS-485, or the like. However, the present invention is not limited to this type of remote data terminal. In general, any man-machine interface capable of eliciting and accepting operator input to acquire the necessary wire winding operation parameters may be utilized. For example, the remote data terminal 410 may comprise a conventional desktop, rack-mount, or portable computer. The keypad 412 may comprise a full keyboard, and/or a pointer device such as a computer mouse, joystick, light pen, or the like. The display 414 may comprise a conventional video display, LCD or active-matrix flat screen display, or the like. The keypad 412 and the display 414 may be combined in a "touchscreen" or similar graphic device that accepts user input. Additionally, the data link between the operator consoles station 400 and the wire winding machine 300 may, in general, comprise any known remote data communications technology and/or protocol. For example, either or both the operator console pedestal 402 and/or the safety interlock 401 may communicate with the wire winding machine 300 via an optical data link, such as an infrared or laser data communications link, and ultrasonic link, or a radio frequency data link.

A control system 450, depicted in FIG. 14, controls the operation of the wire winding machine 300. The control system 450 includes one or more digital processors, microcontrollers, or digital signal processors (DSPs) 452, that controls the wire winding machine 300 according to a stored program 454 residing in a computer memory 456. The memory 456 may comprise RAM, ROM, PROM, EPROM, EEPROM, or the like, as well known in the computer arts.

The stored program 454, as well as other parameters in the memory 456, may be loaded or accessed through the network interface 458 (described below), that is further connected to a computer network 459. In addition to the network interface 458, the control system 450 receives commands and a user input from the operator console 400 and the safety interlock 401, and previously described. The control system sends motion control commands to, and receives position indications from, the left and right spindle position control units 460L, 460R and the left and right end cap position control units 462L, 462R. Actuation of the left and right spindle position control units 460L/R, in coordination with the traverse position control unit 464, determines the "package" or pattern of windings of the wire as it is wound onto the left and right mandrels 324L/R, as described in detail in the incorporated U.S. Pat. No. 5,499,775. Actuation of the left and right end cap position control units 462L, 462R is coordinated with signals received from the safety interlock 401 to ensure operator safety. The traverse cradle position control unit 466 positions the traverse cradle adjacent the left or right winding mandrel 324, as appropriate. This places the traverse 382 in the proper position, feeding wire to the winding mandrel 324 along its axial length. The tensioner position control unit controls the position of the wire tensioner assembly 310 on the wire winding machine 300. The wire tensioner assembly 310 may be retracted to a vertical position, or deployed in a position over the traverse 500. The transfer arm position and extension control unit 470 controls both the rotation of the transfer arm 352 to the four positions listed in Table 1, and the extension and retraction of the wire guide 356 affixed to the transfer arm. The transfer arm position and extension control unit 470 cooperates with the traverse cradle position control unit 466 and the traverse position control unit 464 to effect the transfer of wire from one winding mandrel 324 to the other during continuous wire winding operations.

The provision of a network interface to see control system 450 provides significant flexibility in the operation and maintenance of the wire-winding machine 300. For example, a plurality of wire winding machines 300 may be in operation simultaneously, with each machine 300 winding a different type of wire or cable. Sophisticated tasks such as the loading or troubleshooting of programs 454, the alteration of previously loaded wire winding parameters, or the direct actuation of certain specific components on one or more of the wire winding machine 300—tasks that may be beyond the capacity of the operators sequencing the wire winding machine 300 through their operations and removing the wound packages therefrom—may be performed by engineers or technicians from a computer in their office, across the network. As another example, one or more wire winding machines 300 may be directed through a long or intricate series of wire winding operations by a separate stored program or "script" running on a computer connected to the network, and controlling the wire winding machine(s) 300 via its network interface 458.

The network interface 458 connects the control system 450 with a computer network 459 in data communications relationship. In general, the computer network may comprise any Local Area Network (LAN) or Metropolitan Area Network (MAN). Many LAN/MAN architectures and protocols are defined under the auspices of the Institute of Electrical and Electronics Engineers (IEEE), in particular the IEEE-802 family of LAN/MAN standards. Examples of LAN/MANs include the Ethernet family, Token Ring, FIREWIRE®, or similar digital networks, as are known in the art. In addition, wireless LANs such as for example the BLUETOOTH® wireless ad hoc short-range network standard may be advantageously employed in the present invention. To enable a broad variety of devices to communicate across the network, and additionally to provide robust and error-free data communications, the network typically implements a high-level networking protocol, such as for example, the Transfer Control Program/Internet Protocol (TCP/IP), that is independent of the device-level protocol implemented by a particular network technology. The network interface 458 implements a device-level data communications protocol, such as for example the IEEE 802.3 family of standards, commonly known as the Ethernet standard.

The Ethernet protocol defines a Carrier Sense Multiple Access LAN with Collision Detection (CSMA/CD). The Ethernet technology transmits information between computers and other devices at speeds of 10 and 100 million bits per second (Mbps). The physical network wiring may comprise for example thick or thin coaxial cable, twisted-pair wire, a multi-conductor wire such as RJ-45 cable, or optical fiber. Each device connected to the network, known as a station, operates independently of all other stations on the network; there is no central controller. All stations are connected to the same medium (ie., cable, wire, or fiber). Data are transmitted serially, one bit at a time, over the common medium to every attached station. Data are assembled and transmitted in a logical format known as an Ethernet frame, or packet. Following the transmission of a frame on the network, all stations with data to transmit contend equally for the subsequent frame transmission opportunity. The CSMA/CD protocol ensures that all stations have an equal opportunity to gain access to the network for transmission, and also that only one station will actually do so.

Each station wishing to transmit data across the Ethernet network must wait until there is no signal on the channel (Carrier Sense). If a signal is detected, the station must wait until the carrier ceases before attempting to transmit data. The Ethernet lacks central arbitration; no attached station is assigned a higher priority than any other (Multiple Access). If and when two or more stations began to transmit their frames onto the medium simultaneously, each senses the presence of a signal from another, referred to as a "collision." Each station then terminates in its transmission and waits for a unique period of time before attempting to re-transmit (Collision Detect). In this manner, each station on the network transmits data to one or more other stations on the network in Ethernet frames. Each frame includes two 48-bit unique Media Access Control (MAC) addresses—a destination address defining the intended recipient of the frame, and a source address identifying the transmitting station. The frame additionally includes a variable size data field (from 46 to 1,500 bytes) and an error checking field.

Figure 15:
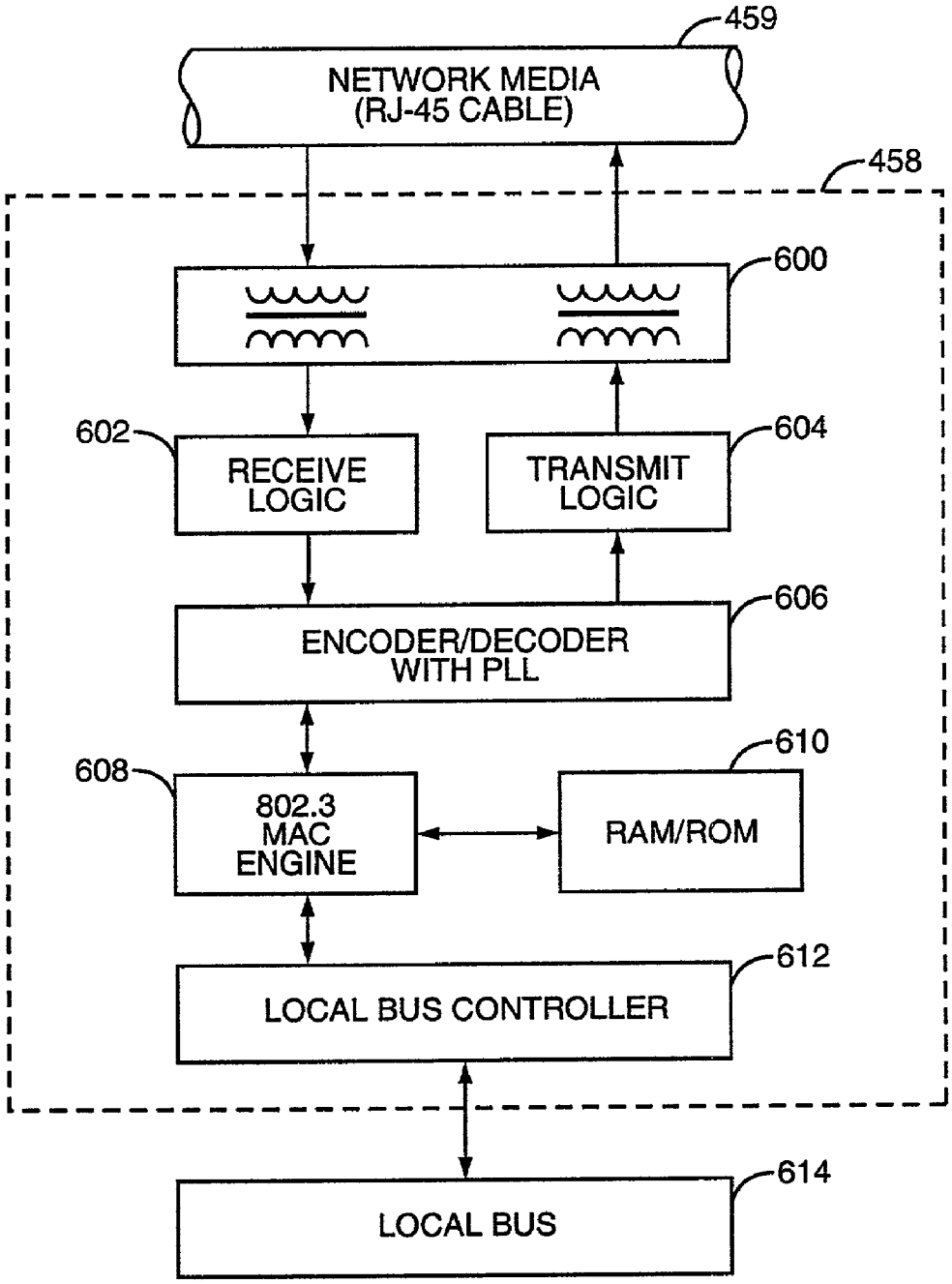
FIG. 15 is a functional block diagram of the network interface to the wire winding machine.

A functional block diagram of one illustrative embodiment of a network interface 458 is depicted in FIG. 15. The network interface 458 communicates with the control system 450 via a local bus 614. The local bus 614 may comprise a standard backplane bus such ISA or PCI, as are well known in the art, or alternatively may comprise the data bus of a processor 452. At the other side, the network interface 458 is connected to the network media 459, such as for example an eight-conductor RJ-45 cable. The network interface 458, and the entire wire winding machine 300, are DC-isolated from the network media 459 by interface transformers 600. Dynamic data pulses passing through the interface transformers 600 from the network media 459 are processed by receive logic 602, and transmit logic 604 prepares data pulses for transmission through the interface transformers 600. The receive and transmit logic blocks 602, 604 contain analog-to digital and digital-to analog converters, respectively, shift registers for serial/parallel format transfer, and related circuits. The encounter/decoder block 606 translates data between the digital domain and the encoding scheme utilized by the network 459 (such as Manchester, NRZ, or the like, as are known in the art), under the control of the Media Access Control (MAC) engine 608. The encoder/decoder block 606 includes a phase locked loop and associated timing circuits to precisely encode and decode transmit and receive data, respectively. The MAC engine controls the network interface 458, including the assembly/extraction of data into/from Ethernet frames, compliance with the CSMA/CD protocol, snooping network traffic to identify data frames transmitted to it, performing data integrity checks and error correction, and similar implementation and housekeeping tasks. The MAC engine 608 is in data communications with computer memory 610, which may include RAM and ROM. The memory 610 provides program storage for the MAC engine 608, data buffering, scratch space for calculations, and the like. The local bus controller 612 formats the logical and timing packaging of data transferred between the network interface and the local bus 614. Where the local bus 614 comprises a standard backplane bus such as an ISA bus, the network interface 458 may be implemented as standard component, such as for example the CS8900A 10 Mbit Ethernet LAN Controller available from Cirrus Logic of Austin, Tex.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. A wire winding machine comprising:

a pair of rotatably driven spaced apart mandrels, each mandrel being rotatable about an axis;

a traverse for guiding wire onto each one of the pair of mandrels, one mandrel at a time;

the traverse being moveable between first and second positions such that in the first position the traverse acts to guide wire onto one of the mandrels and in the second position the traverse acts to guide wire onto the other mandrel; and wherein the traverse is moveable along an arcuate path as the traverse moves between the first and second positions, and wherein the movement of the traverse is confined to movement between the two axis of the mandrels.

2. The wire winding machine of claim 1 wherein as the traverse moves between the first and second positions, the traverse swings about an axis.

3. The wire winding machine of claim 1 including a frame structure and wherein the axis extends transversely across the frame structure of the wire winding machine.

4. The wire winding machine of claim 2 including a double acting fluid cylinder for swinging the traverse between the first and second positions.

5. The wire winding machine of claim 1 including a frame rotatably mounted on a shaft, the traverse being mounted to the frame and moveable therewith.

6. The wire winding machine of claim 5 including a fluid cylinder operatively connected to the frame for moving the frame back and forth about the shaft.

7. The wire winding machine or claim 6 wherein the cylinder is connected between a frame structure associated with the wire winding machine and the frame.

8. The wire winding machine of claim 5 wherein the frame includes a cradle suspended from the shaft.

9. The wire winding machine of claim 5 wherein the frame includes a generally rectangular frame structure and a pair of swing arms, the swing arms being secured to the rectangular frame structure and rotatably journaled around the shaft such that the rectangular frame may swing back and forth on the shaft.

10. The wire winding machine of claim 1 further including a single transfer arm for transferring wire from one of the mandrels to the other of the mandrels.

11. A wire winding machine comprising:

a pair of spaced apart mandrels;

a traverse for guiding wire onto each one of the pair of mandrels, one mandrel at a time;

a frame having said traverse mounted thereto;

the frame being moveably mounted for swinging movement about an axis;

an actuator operatively connected to the frame for moving the frame back and forth resulting in the traverse being moved back and forth about an arcuate path;

wherein the frame comprises a generally rectangular closed frame that includes at least four members interconnected with the individual members being disposed at generally right angles to adjacent members.

12. The wire winding machine of claim 11 including a shaft for supporting the frame and wherein the frame is moveable back and forth about the shaft.

13. The wire winding machine of claim 11 wherein the actuator includes a double-acting fluid cylinder operatively connected between the frame and a frame structure associated with the wire winding machine.

14. The wire winding machine of claim 12 wherein the frame includes a pair of spaced-apart arms with the arms being rotatably journaled about the axis of the shaft.

15. The wire winding machine of claim 11 wherein the traverse is cantilevered from the frame and projects outwardly therefrom.

16. A method of winding wire onto each of two mandrels of a dual head wire winding machine, each mandrel including an axis of rotation, comprising:

a. directing wire to a traverse and from the traverse to one of the two mandrels;

b. winding wire on one mandrel and then transferring the wire to the other mandrel, and continuing to wind wire on the respective mandrels, one mandrel at a time, and transferring the wire from one mandrel to another;

c. moving the traverse from one position to another position in the course of transferring wire from one mandrel to the other;

d. wherein moving the traverse from one position to another includes swinging the traverse in an arcuate path between the positions; and e. confining the traverse between the two axis of the mandrels.

17. The method of claim 16 wherein the traverse is mounted to a frame that is suspended from a shaft, and wherein there is provided an actuator for moving the frame about the axis of the shaft such that the traverse is moved between the two positions.

18. The method of claim 16 including cantilevering the traverse from the frame and suspending the frame from a support structure that permits the frame to move back and forth about an axis.

19. The method of claim 18 including suspending the frame from a shaft and utilizing a double-acting fluid cylinder to move the frame back and forth about the axis of the shaft, resulting in the traverse being moved back and forth in an arcuate path.

20. A wire winding machine comprising:

at least one mandrel for winding wire;

a traverse for directing wire to the mandrel; and a wire directional control device for receiving the wire being directed to the mandrel and engaging the wire in such a manner that the wire can move through the device in one direction but is prohibited from moving through the device in a direction, generally opposite the one direction.

21. The wire winding machine of claim 20 wherein the wire directional control device includes a pair of control rollers that engage the wire and permit the wire to move therebetween.

22. The wire winding machine of claim 21 wherein one of the control rollers is bodily movable with respect to the other roller.

23. The wire winding machine of claim 22 wherein the bodily movable control roller is mounted on a pivoting arm.

24. The wire winding machine of claim 23 wherein the pivoting arm is oriented such that the wire freely moves between the control rollers in one direction and binds when the wire is urged in an opposite direction.

25. The wire winding machine of claim 21 wherein the wire directional control device includes a pair of inlet idler rollers and a pair of outlet idler rollers and wherein the control rollers are disposed between the inlet and outlet idler rollers.

26. The wire winding machine of claim 25 wherein one of the control rollers is rotatably mounted about a fixed axis while the other control roller is mounted on a pivot arm and is moveable back and forth with respect to the roller mounted about the fixed axis.

27. The wire winding machine of claim 26 wherein the moveable roller mounted on the pivot arm is spring-biased towards the fixed control roller.

28. The wire winding machine of claim 27 wherein the spring-biased control roller is operative to move and permit a wire to move between the two control rollers in one direction but is operative to bind against the wire when the wire is moved in a generally opposite direction thereby preventing the wire from moving in the opposite direction.

29. The wire winding machine of claim 28 wherein each control roller includes an aggressive surface.

30. The wire winding machine of claim 29 wherein the aggressive surface includes a series of vertical wire engaging elements that project outwardly from each control roller.

31. A wire winding machine comprising:

at least one rotatable mandrel for winding wire thereon;

a traverse for moving back and forth and guiding the wire onto the mandrel as wire is wound onto the mandrel;

a wire directional control device mounted on the traverse for receiving wire being fed from the traverse to the mandrel, said wire directional control device including:

i. a pair of rollers mounted adjacent to each other and including a fixed roller and a movable roller with the fixed roller being mounted about a fixed axis and the movable roller being mounted on a movable arm and movable back and forth with respect to the fixed roller;

ii. wherein a wire passing from the traverse is fed between the fixed and movable roller and passes therethrough as the wire is fed to the mandrel; and iii. wherein the movable roller and arm are oriented relative to the fixed roller such that the wire can move between the fixed roller and movable roller in a first direction and wherein the orientation of the movable roller and arm relative to the fixed roller is such that the wire will bind between the rollers if moved in a direction generally opposite the first direction, whereby the wire directional control device permits the movement of the wires through the device in a first direction but prevents the wire from moving back through the device in a direction generally opposite the first direction.

32. The wire winding machine of claim 31 wherein the movable roller is biased towards the fixed roller.

33. The wire winding machine of claim 32 wherein the arm having the movable roller mounted thereto is pivotally mounted.

34. The wire winding machine of claim 33 including a pair of inlet idler rollers and a pair of outlet idler rollers, and wherein the pair of control rollers are disposed between the inlet and outlet idler rollers.

35. The wire winding machine of claim 33 wherein each control roller includes an aggressive surface for engaging the wire being fed therebetween.

36. The wire winding machine of claim 33 wherein the axis of rotation of the movable roller is maintained on one side of a reference line extending between the axis of rotation of the fixed roller and the axis of rotation of the arm.

37. The wire winding machine of claim 36 wherein the axis of rotation of the movable roller is maintained on a downstream side of the reference line.

38. The wire winding machine of claim 36 wherein the control rollers and idler rollers are mounted on a frame.

39. The wire winding machine of claim 36 wherein the movable roller is biased towards the fixed roller by a spring operatively connected to the movable roller and fixed at a point spaced from the movable roller.

40. The wire winding machine of claim 1 wherein the wire winding machine includes a main frame and wherein the mandrels project outwardly from one side the main frame; and wherein the traverse is secured to a supporting frame structure mounted to the main frame structure inwardly of the mandrels and wherein the traverse projects outwardly from the main frame structure.

41. The wire winding machine of claim 40 further including a shaft mounted to the main frame structure, a pair of arms rotatively mounted to the shaft and depending downwardly therefrom, and wherein the supporting frame structure of the traverse is secured to the arms such that the supporting frame structure of the traverse swings back and forth as the arms rotate on the shaft.

42. The wire winding machine of claim 31 wherein the supporting frame of the traverse comprises a generally rectangular frame that includes at least four members interconnected with individual members being disposed at generally right angles to adjacent members.

* * * * *